US010578396B2

(12) United States Patent
Teetzel et al.

(10) Patent No.: US 10,578,396 B2
(45) Date of Patent: Mar. 3, 2020

(54) MODULAR GRENADE LAUNCHER SYSTEM

(71) Applicant: WILCOX INDUSTRIES CORP., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 594 days.

(21) Appl. No.: 14/955,363

(22) Filed: Dec. 1, 2015

(65) Prior Publication Data

US 2016/0153744 A1 Jun. 2, 2016

Related U.S. Application Data

(60) Provisional application No. 62/085,967, filed on Dec. 1, 2014.

(51) Int. Cl.
*F41C 27/06* (2006.01)
*F41A 11/02* (2006.01)

(52) U.S. Cl.
CPC ..... *F41C 27/06* (2013.01); *F41A 11/02* (2013.01)

(58) Field of Classification Search
CPC ..... F41C 27/06; F41A 11/02
USPC ..... 42/105
See application file for complete search history.

(56) References Cited

U.S. PATENT DOCUMENTS 3,279,114 A * 10/1966 Lewis ..... F41C 27/06 42/105
3,332,162 A * 7/1967 Martwick ..... F41C 27/06 42/105
3,365,828 A * 1/1968 Badali ..... F41A 9/37 42/105
3,442,173 A * 5/1969 Muller ..... F41A 19/21 42/105
3,507,067 A * 4/1970 Into ..... F41A 19/40 42/10
3,557,482 A * 1/1971 Hoover ..... F41C 27/06 42/1.07
3,641,691 A * 2/1972 Ellis ..... F41C 27/06 42/105
3,967,402 A * 7/1976 Cooksey ..... F41A 3/58 42/10

(Continued)

OTHER PUBLICATIONS

"Gluck Super Tactical Body Dropper" (Handgun Holsters and Guns) (online) (retrieved from the Internet on Sep. 3, 2016) <URL https://brokenlizard.wordpress.com/2010/10/15/glock-super-tactical-body-dropper/>, Oct. 15, 2010.

(Continued)

*Primary Examiner* — Michelle Clement
(74) *Attorney, Agent, or Firm* — McLane Middleton, Professional Association

(57) ABSTRACT

A modular grenade launcher system includes an upper chassis and lower chassis secured on opposite sides of a barrel of a weapon, such as a firearm. The chassis removably receives any of a plurality of interchangeable modules, including grenade launcher assemblies having different calibers. A separate modular and removable firing mechanism is provided, wherein multiple grenade launcher barrel assemblies can share a common firing mechanism. An accessory rail module is also provided to replace the grenade launcher barrel assembly and firing mechanism.

21 Claims, 26 Drawing Sheets

(56) References Cited

U.S. PATENT DOCUMENTS 3,967,403 A * 7/1976 Reynolds ..... F41A 3/14 42/10
4,019,424 A * 4/1977 Reynolds ..... F41A 9/18 42/105
4,603,498 A * 8/1986 Johnson ..... F41A 17/44 42/105
4,689,911 A * 9/1987 White ..... F41A 19/39 42/1.06
4,733,489 A * 3/1988 Kurak ..... F41C 27/06 42/105
5,052,144 A * 10/1991 Ostor ..... F41A 9/25 42/105
5,146,705 A * 9/1992 Martin ..... F41A 17/46 42/70.06
5,198,600 A * 3/1993 E'Nama ..... F41C 27/00 42/105
5,235,771 A * 8/1993 Sokol ..... F41C 27/06 42/105
5,591,932 A * 1/1997 Staiert ..... F41A 1/04 42/10
5,669,174 A * 9/1997 Teetzel ..... F41A 9/62 356/5.01
5,689,908 A * 11/1997 Brandl ..... F41A 11/02 42/71.01
5,930,935 A * 8/1999 Griffin ..... F41C 27/06 42/105
6,142,058 A * 11/2000 Mayville ..... F41B 11/51 124/74
6,250,194 B1 * 6/2001 Brandl ..... F41A 19/18 42/71.01
6,453,594 B1 * 9/2002 Griffin ..... F41C 27/06 42/105
6,481,145 B2 * 11/2002 Weichert ..... F41C 27/06 42/105
6,752,137 B2 * 6/2004 Brunette ..... F41B 11/55 124/73
6,829,858 B2 * 12/2004 Gablowski ..... F41C 27/06 42/105
D517,637 S * 3/2006 Murello ..... D22/100
7,010,879 B2 * 3/2006 Olson ..... F41A 17/74 42/105
7,021,187 B1 * 4/2006 Grassi ..... F42B 30/04 89/6.5
7,143,539 B2 * 12/2006 Cerovic ..... F41A 19/58 42/84
7,269,920 B2 * 9/2007 Staley, III ..... F41G 1/38 42/111
7,328,530 B2 * 2/2008 Griffin ..... F41A 21/48 42/105
7,360,478 B2 * 4/2008 Compton ..... F41A 35/06 42/105
7,409,912 B2 * 8/2008 Cerovic ..... F41H 13/0018 102/502
7,458,179 B2 * 12/2008 Swan ..... F41G 11/003 42/105
7,487,612 B2 * 2/2009 Macaluso ..... F41C 7/025 42/10
7,661,348 B2 * 2/2010 Murello ..... F41A 11/02 89/6
7,891,130 B2 * 2/2011 Griffin ..... F41C 27/06 42/105
7,966,763 B1 * 6/2011 Schneider ..... F41C 27/06 42/105
8,020,334 B2 * 9/2011 Delmonico ..... F41C 27/00 42/105
8,141,289 B2 * 3/2012 Gomez ..... F41C 23/16 42/90
8,191,300 B2 * 6/2012 Daniel ..... F41C 23/16 42/71.01
8,209,897 B2 * 7/2012 Schneider ..... F41C 27/06 42/105
8,296,985 B2 * 10/2012 Krutil ..... F41A 3/58 42/105
8,393,107 B2 * 3/2013 Brown ..... F41C 7/00 42/105
8,459,996 B2 * 6/2013 Sullivan ..... F41G 3/265 42/114
8,549,783 B2 * 10/2013 Marquez ..... F41A 11/02 42/71.01
8,991,091 B2 * 3/2015 Griffin ..... F41C 27/06 42/105
9,021,733 B1 * 5/2015 DiChario ..... F41A 3/66 42/69.01
9,228,801 B2 * 1/2016 Hosz ..... F41C 27/06
9,618,299 B1 * 4/2017 Gingrich ..... F41C 27/18
2001/0042334 A1 * 11/2001 Weichert ..... F41C 27/06 42/105
2004/0025395 A1 * 2/2004 Gablowski ..... F41C 27/06 42/105
2005/0132628 A1 * 6/2005 Olson ..... F41A 17/74 42/105
2005/0188593 A1 * 9/2005 Cerovic ..... F41A 19/58 42/77
2006/0026884 A1 * 2/2006 Cerovic ..... F41A 19/58 42/84
2006/0026885 A1 * 2/2006 Tony ..... F41A 19/10 42/105
2006/0201044 A1 * 9/2006 Griffin ..... F41A 21/48 42/105
2006/0272193 A1 * 12/2006 Zedrosser ..... F41C 27/06 42/105
2007/0068057 A1 * 3/2007 Macaluso ..... F41C 7/025 42/105
2007/0074437 A1 * 4/2007 Compton ..... F41A 35/06 42/12
2008/0216378 A1 * 9/2008 Murello ..... F41A 11/02 42/75.02
2009/0178325 A1 * 7/2009 Veilleux ..... F41G 1/36 42/117
2009/0277069 A1 * 11/2009 Delmonico ..... F41C 27/00 42/105
2010/0192439 A1 * 8/2010 Murello ..... F41A 25/10 42/1.06
2011/0010981 A1 * 1/2011 Wieland ..... F41G 1/473 42/114
2011/0016765 A1 * 1/2011 Griffin ..... F41A 21/48 42/105
2011/0131857 A1 * 6/2011 Kuczynko ..... F41A 3/84 42/73
2012/0144712 A1 * 6/2012 Rostocil ..... F41A 9/79 42/16
2012/0151813 A1 * 6/2012 Brown ..... F41C 7/00 42/73
2012/0297970 A1 11/2012 Langevin et al.
2014/0190061 A1 * 7/2014 Griffin ..... F41C 27/06 42/105
2014/0237883 A1 * 8/2014 Hosz ..... F41C 27/00 42/105
2015/0007477 A1 * 1/2015 Langevin ..... F41C 23/16 42/71.01
2015/0107143 A1 * 4/2015 Coetzee ..... F41G 11/003 42/14
2015/0135576 A1 * 5/2015 Wells ..... F41C 23/16 42/90

OTHER PUBLICATIONS

International Application No. PCT/US2015/063175 filed Dec. 1, 2015.
Search Report dated Mar. 25, 2016 received in PCT/US2015/063175.

* cited by examiner

MODULAR GRENADE LAUNCHER SYSTEM

CROSS REFERENCE TO RELATED APPLICATION

This application claims the priority benefit of U.S. Provisional Application No. 62/085,967 filed Dec. 1, 2014. The aforementioned provisional application is incorporated herein by reference in its entirety.

BACKGROUND

The present development relates to grenade launchers and, more particularly, to a modular grenade launcher system which provides quick attachment and removal from a firearm and one or more barrels interchangeable with one or more additional barrels and/or accessory rail sections. In a further aspect, the modular grenade launcher system herein may also be configured as a handheld, standalone grenade launcher.

SUMMARY

In one aspect, a barrel-interchangeable weapon system for use in conjunction with a firearm includes a chassis capable of being attached to and detached from the firearm. The chassis is configured to removably attach a modular grenade launcher system. The modular grenade launcher system comprises at least one trigger assembly and at least one grenade launcher barrel assembly. The chassis includes an upper chassis portion and a lower chassis portion removably attachable to the upper chassis portion. The chassis is configured to circumscribe the barrel of the firearm. The upper chassis portion has at least one lower edge and the lower chassis portion has at least one upper edge engaging the at least one lower edge. A first fastener on a lower surface of the lower chassis portion is capable of being attached to and detached from the at least one grenade launcher barrel assembly. A second fastener on a lower surface of the lower chassis portion is capable of being attached to and detached from the at least one trigger assembly.

In another aspect, a barrel-interchangeable weapon system includes a frame having a fore end portion and a buttstock portion and a chassis capable of being attached to and detached from the frame. The chassis is configured to removably attach a modular grenade launcher system. The modular grenade launcher system comprises at least one trigger assembly and at least one grenade launcher barrel assembly. The chassis includes an upper chassis portion and a lower chassis portion removably attachable to the upper chassis portion. The chassis is configured to circumscribe the fore end portion of the frame. The upper chassis portion has at least one lower edge and the lower chassis portion has at least one upper edge engaging the at least one lower edge. A first fastener on a lower surface of the lower chassis portion is capable of being attached to and detached from the at least one grenade launcher barrel assembly. A second fastener on a lower surface of the lower chassis portion is capable of being attached to and detached from the at least one trigger assembly.

BRIEF DESCRIPTION OF THE DRAWING

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
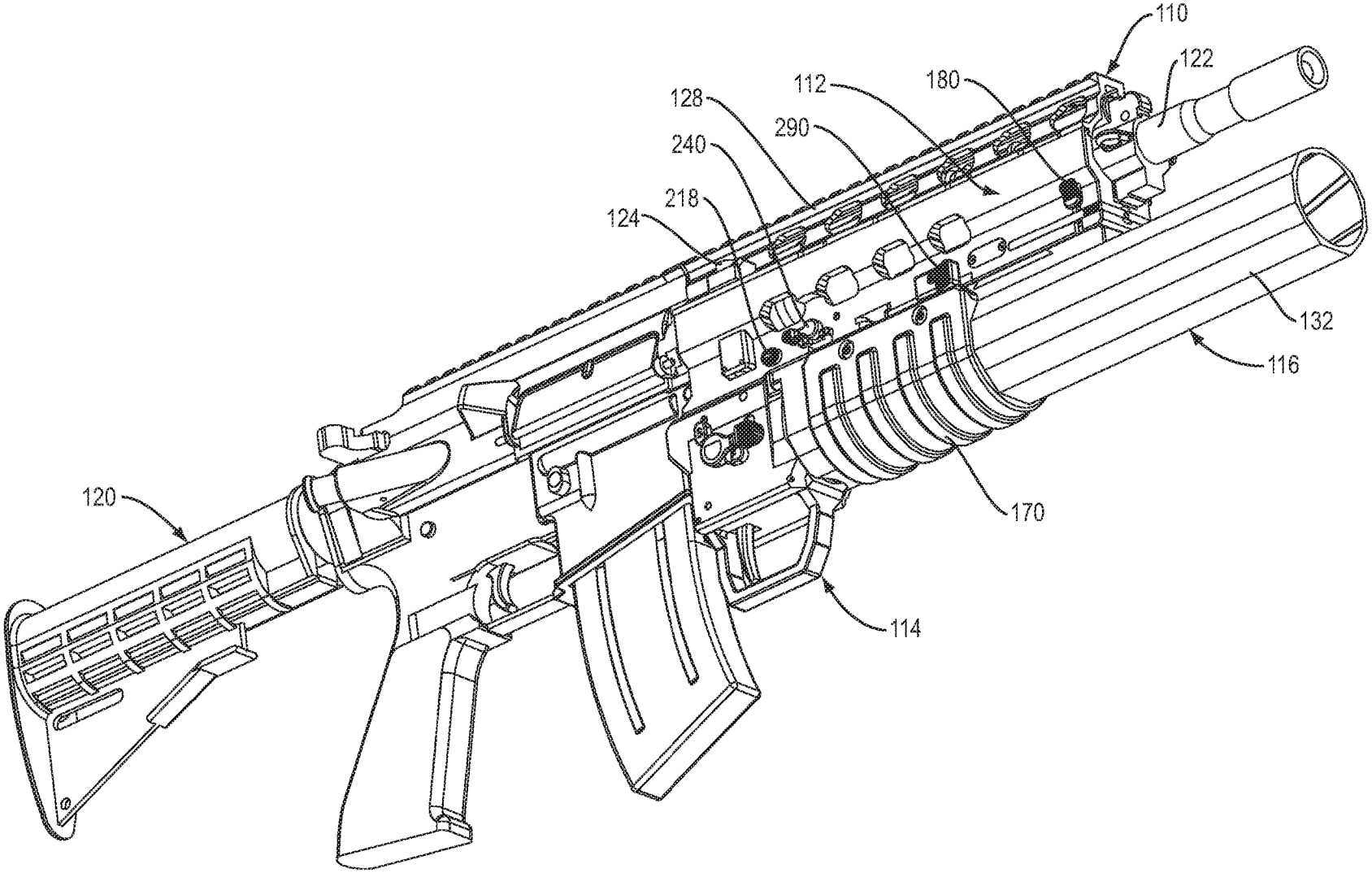
FIG. 1 is an isometric view taken generally from the side and below of an exemplary grenade launcher system herein attached to an assault rifle and employing an interchangeable 40 mm grenade launcher barrel module.
Figure 2:
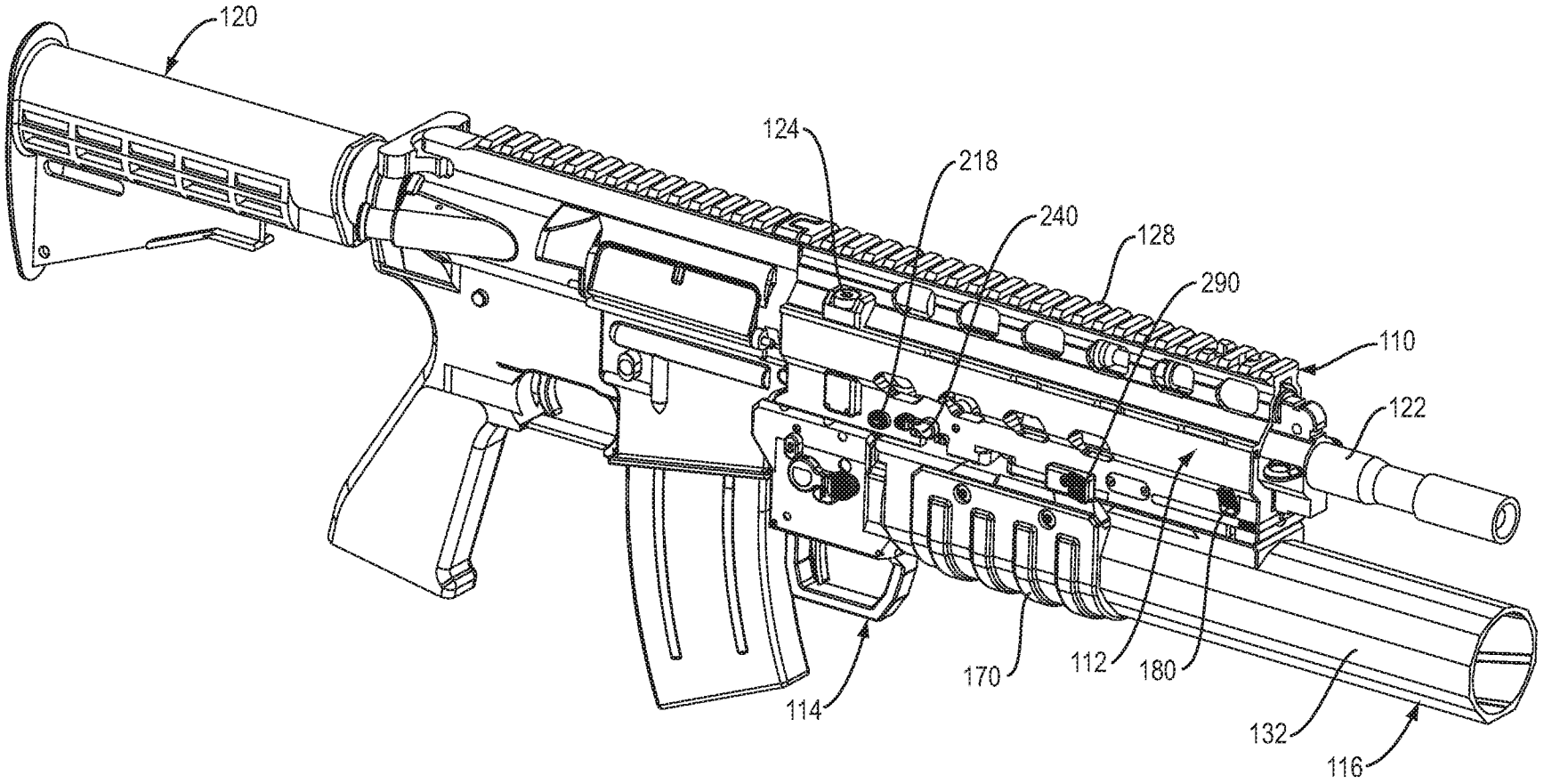
FIG. 2 is an isometric view of the grenade launcher system appearing in FIG. 1, taken generally from the side and above.

Referring now to the drawings, a first exemplary embodiment exemplary grenade launcher system appears in FIGS. 1 and 2. The grenade launcher system includes an upper chassis 110 and a lower chassis 112 which are secured to each other about opposite sides of a barrel 122 of a firearm 120. The present system may advantageously be employed with a Heckler & Koch 416, although it will be recognized that the present system may be used with any standard assault rifle, including without limitation an M4, AR15, or M16 rifle or carbine or the like. A firing mechanism 114 and a grenade launcher barrel assembly 116 are secured to the lower chassis 112.

The upper chassis 110 may be configured as a replacement for an upper hand guard of the firearm 120. The upper chassis 110 includes a pair of openings 118 on opposite lateral sides of the barrel 122. Threaded bolts 124 pass through the openings 118 and engage aligned openings 126 formed in the lower chassis 112 in cooperation with the threaded block nuts 127 attached to the lower chassis with fasteners 129. The upper chassis 110 includes an upper accessory rail 128, which may be a Picatinny rail (MIL-STD-1913, STANAG-2324) or other tactical rail. In the illustrated embodiment, the upper chassis and the lower chassis are secured about the barrel 122, e.g., via a clamping attachment to the barrel or a component adjacent the barrel, such as the receiver, barrel nut, or the like. Clearance may be provided between the barrel and the upper and lower chassis members for the gas block, gas tube, etc.

Figure 3:
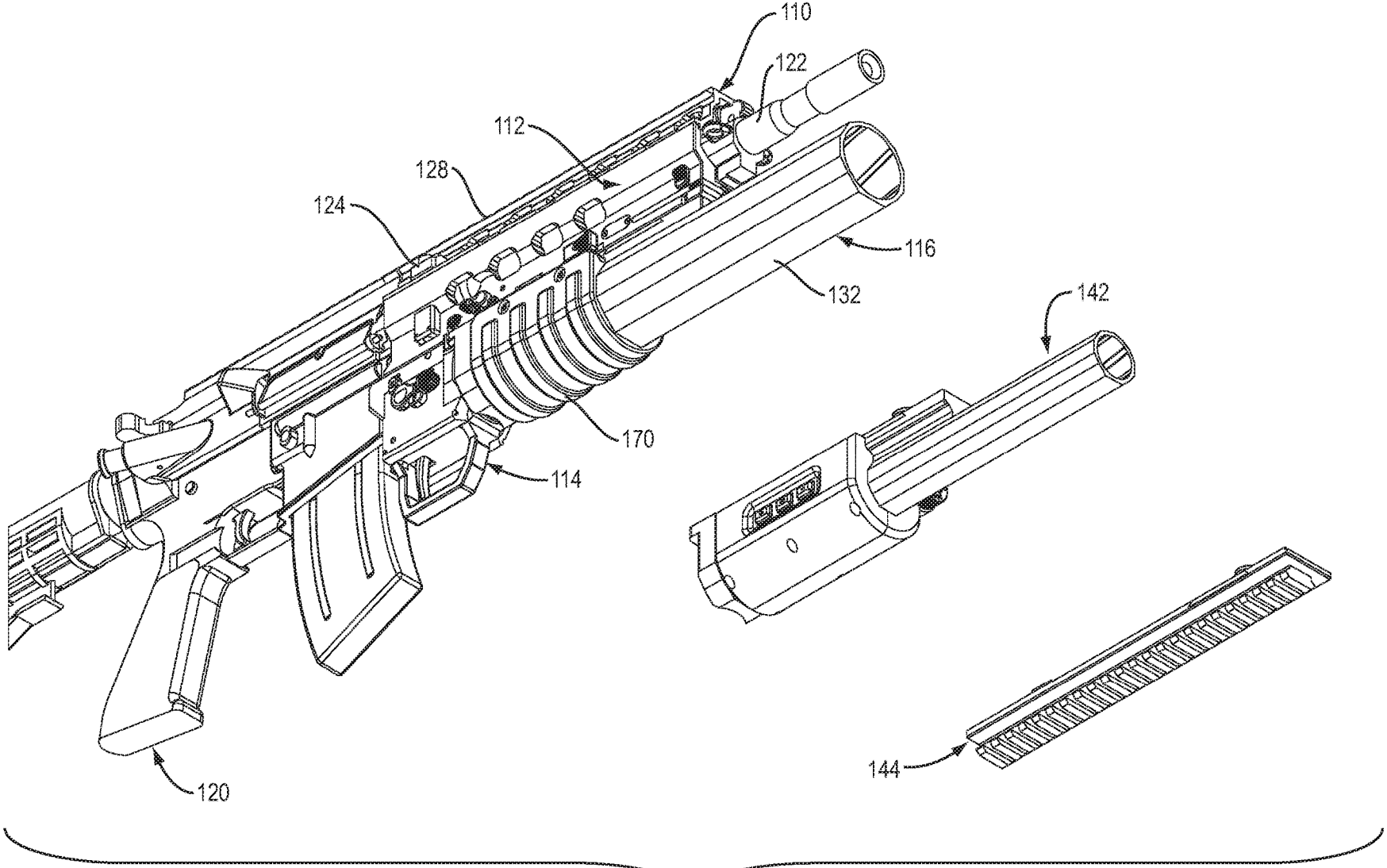
FIG. 3 is an isometric view similar to the view appearing in FIG. 1, illustrating additional interchangeable components.
Figure 4:
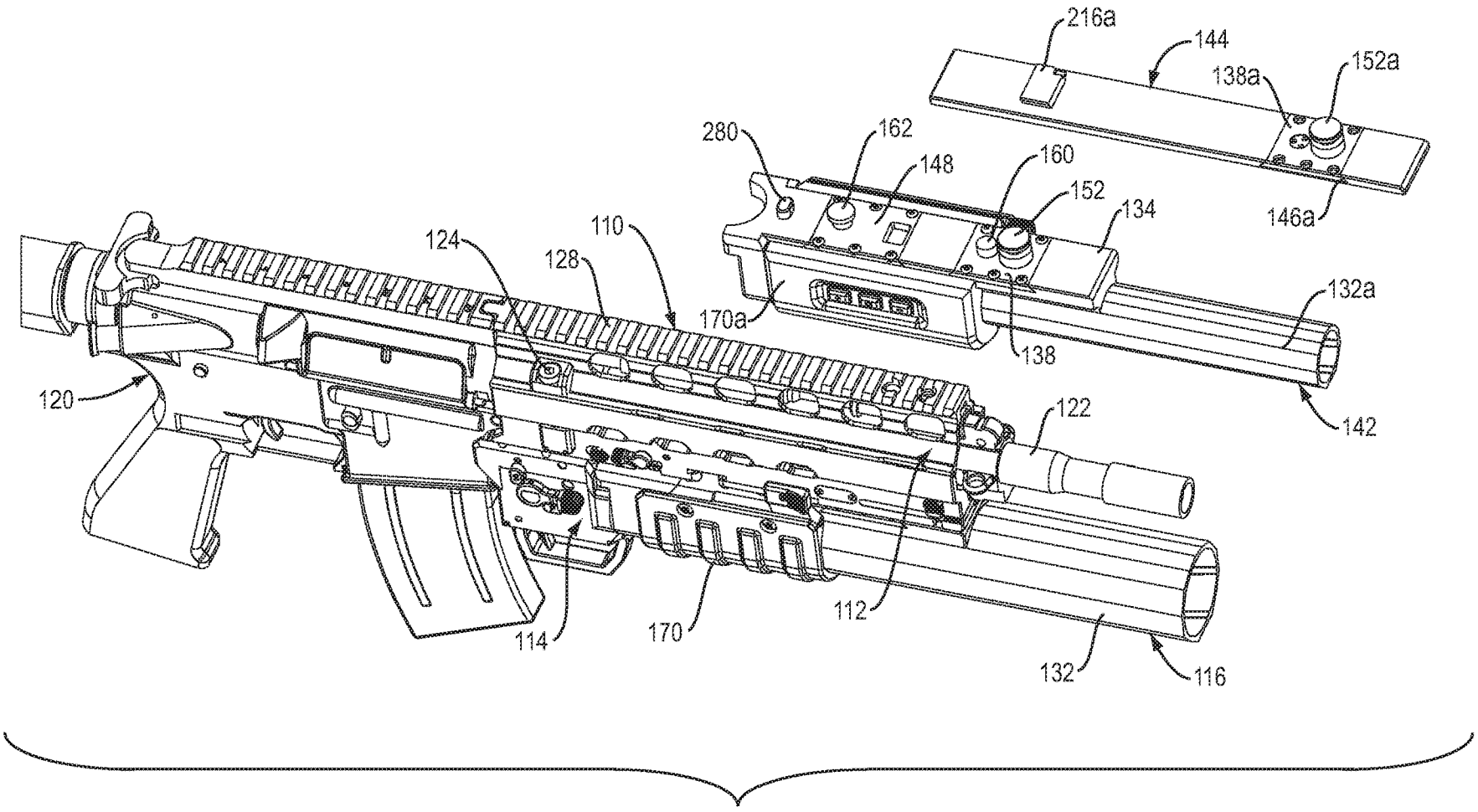
FIG. 4 is an isometric view illustrating the additional interchangeable components appearing in FIG. 3, taken generally from above.
Figure 5:
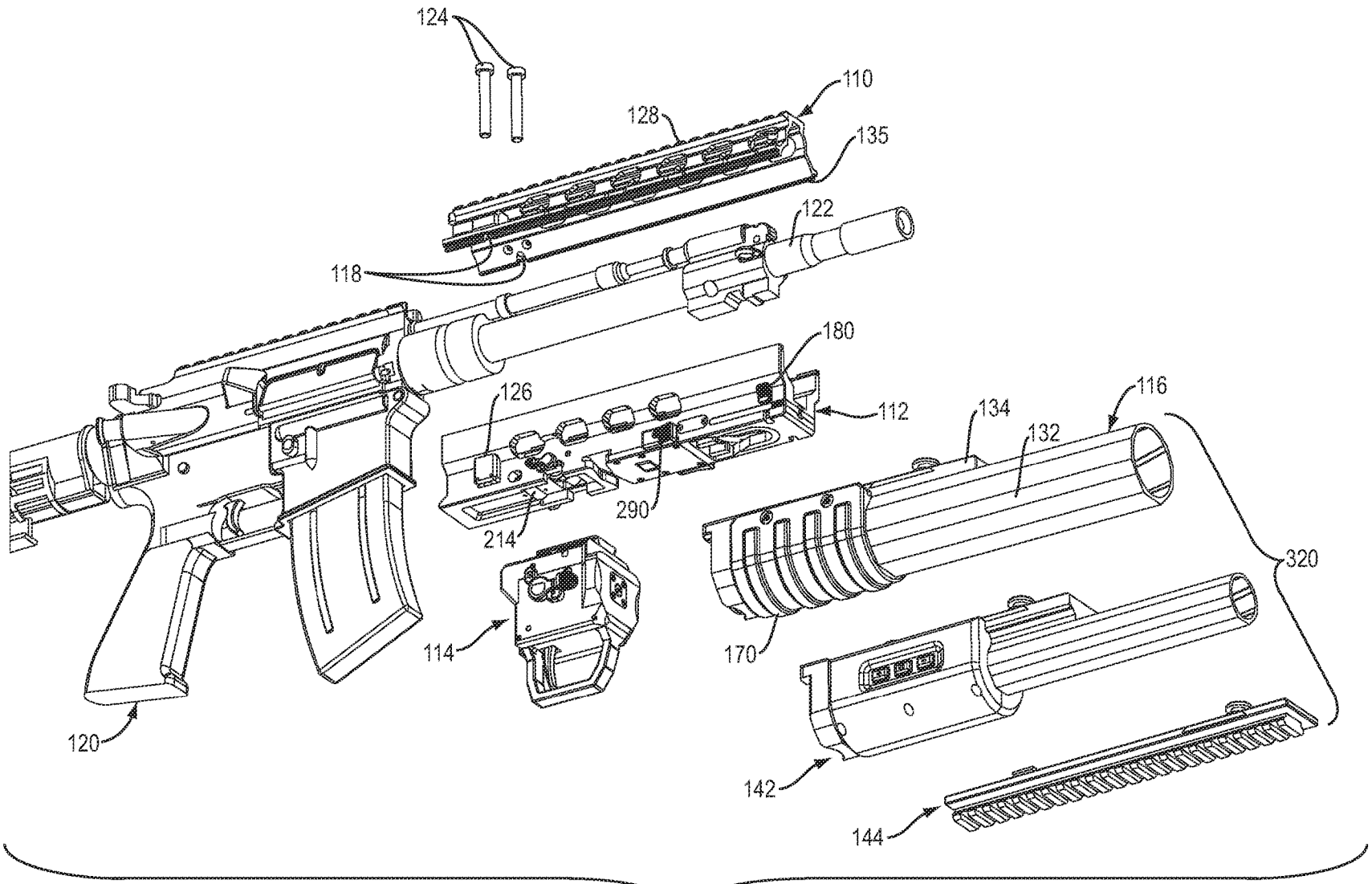
FIG. 5 is an exploded view illustrating the manner of connecting the upper and lower chassis, firing mechanism, and interchangeable components.
Figure 6:
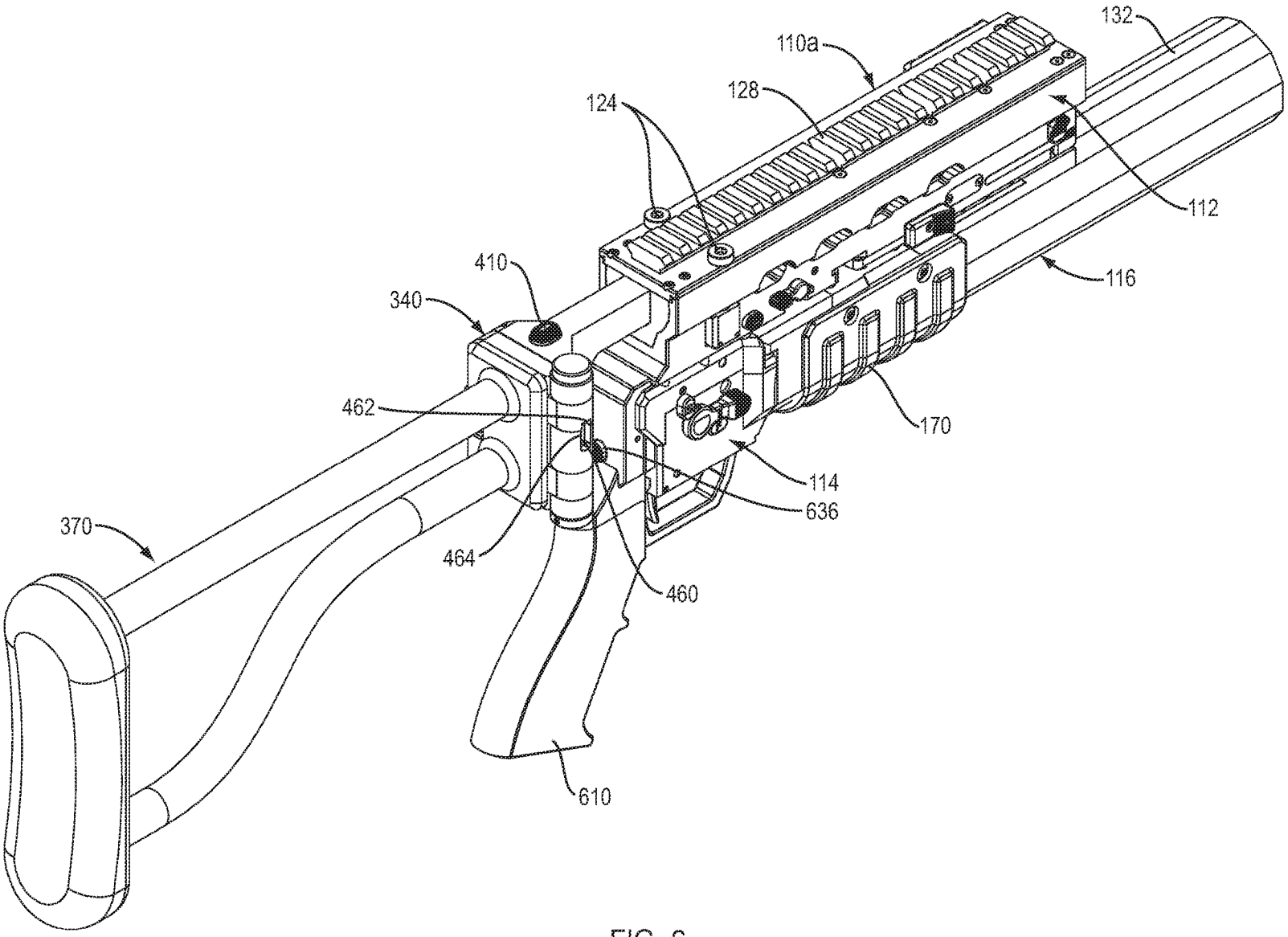
FIG. 6 illustrates an alternative embodiment employing a barrel-interchangeable weapon body including a fore end portion and a buttstock portion, the weapon body cooperating with a selected barrel assembly and trigger assembly to provide a standalone grenade launcher.
Figure 7:
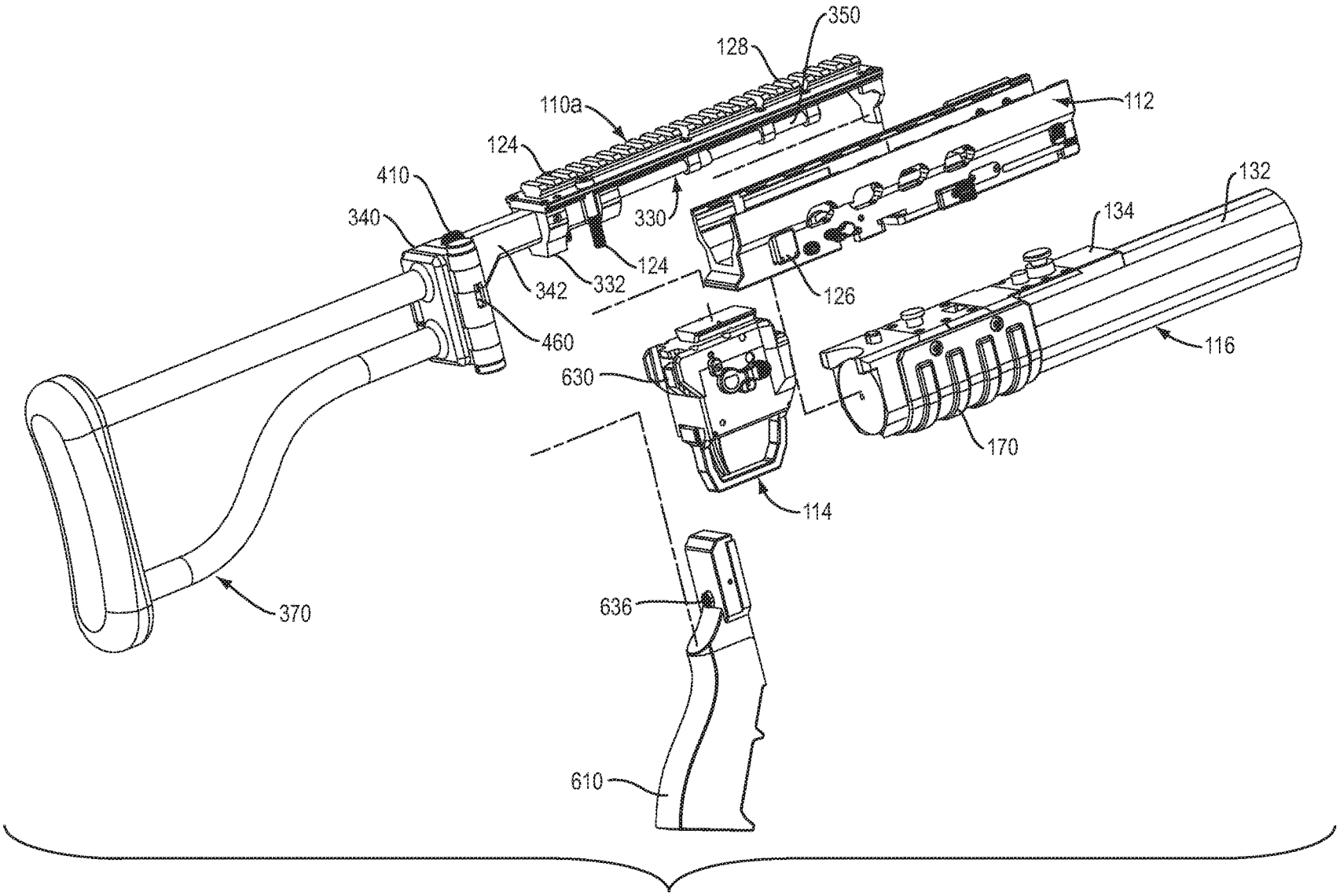
FIG. 7 is an exploded view of the embodiment appearing in FIG. 6.
Figure 8:
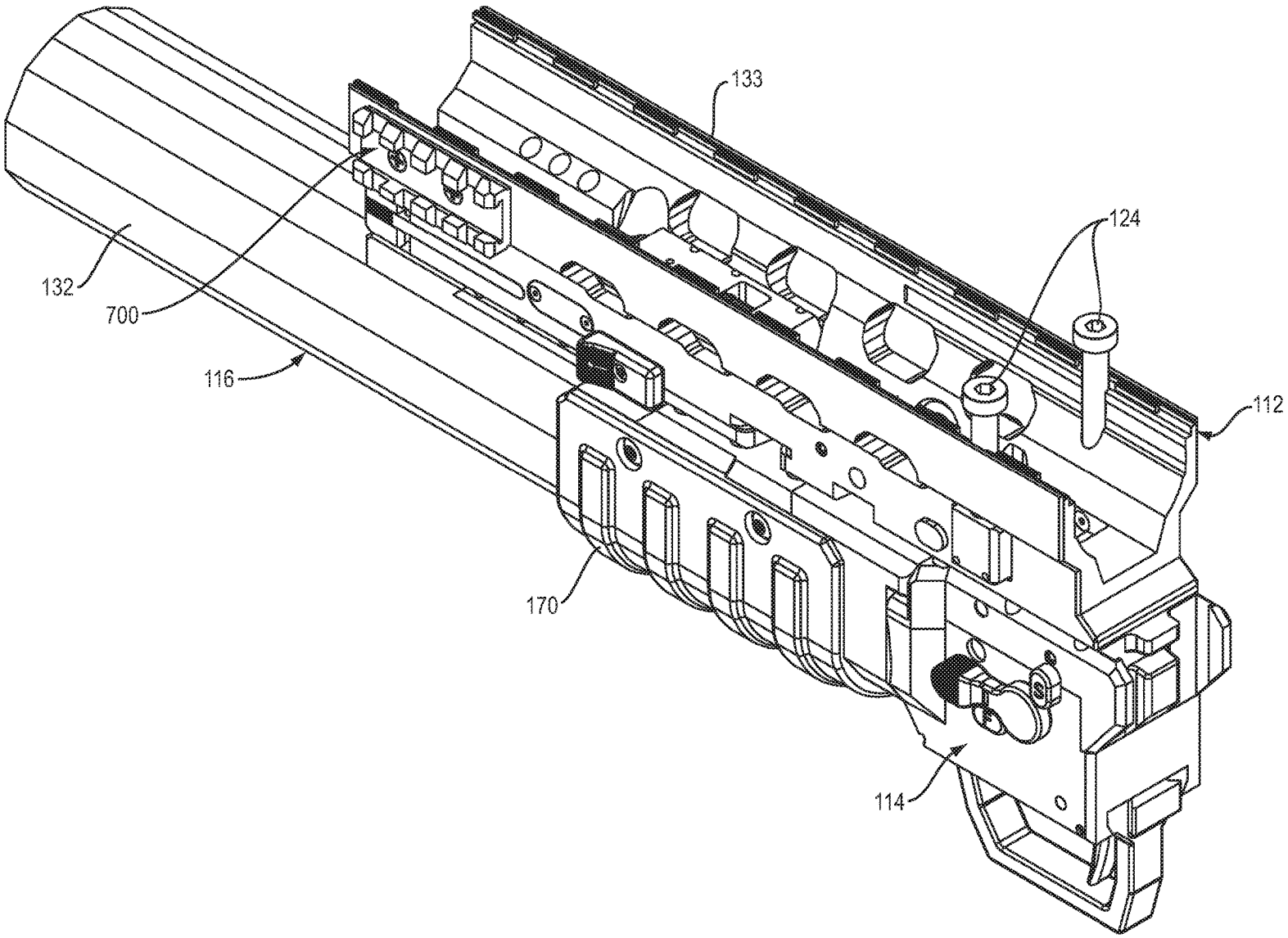
FIG. 8 is an isometric view of the lower portion of the gun-mounted configuration, namely, the firing mechanism, the lower rail, and the 40 mm barrel.

As best seen in FIGS. 3-5, the lower chassis 112 is configured to interchangeably receive a plurality 320 of interchangeable components. In the illustrated embodiment, the interchangeable components include the grenade launcher barrel assembly 116, which may be for example a 40 mm barrel and one or more alternative caliber barrel assemblies 142, which may include for example a 25 mm airburst or smart grenade launcher barrel. In certain embodiments, an accessory rail plate 144 may also be provided for interchangeable attachment in place of the grenade launcher barrel assemblies 116, 142.

Figure 9:
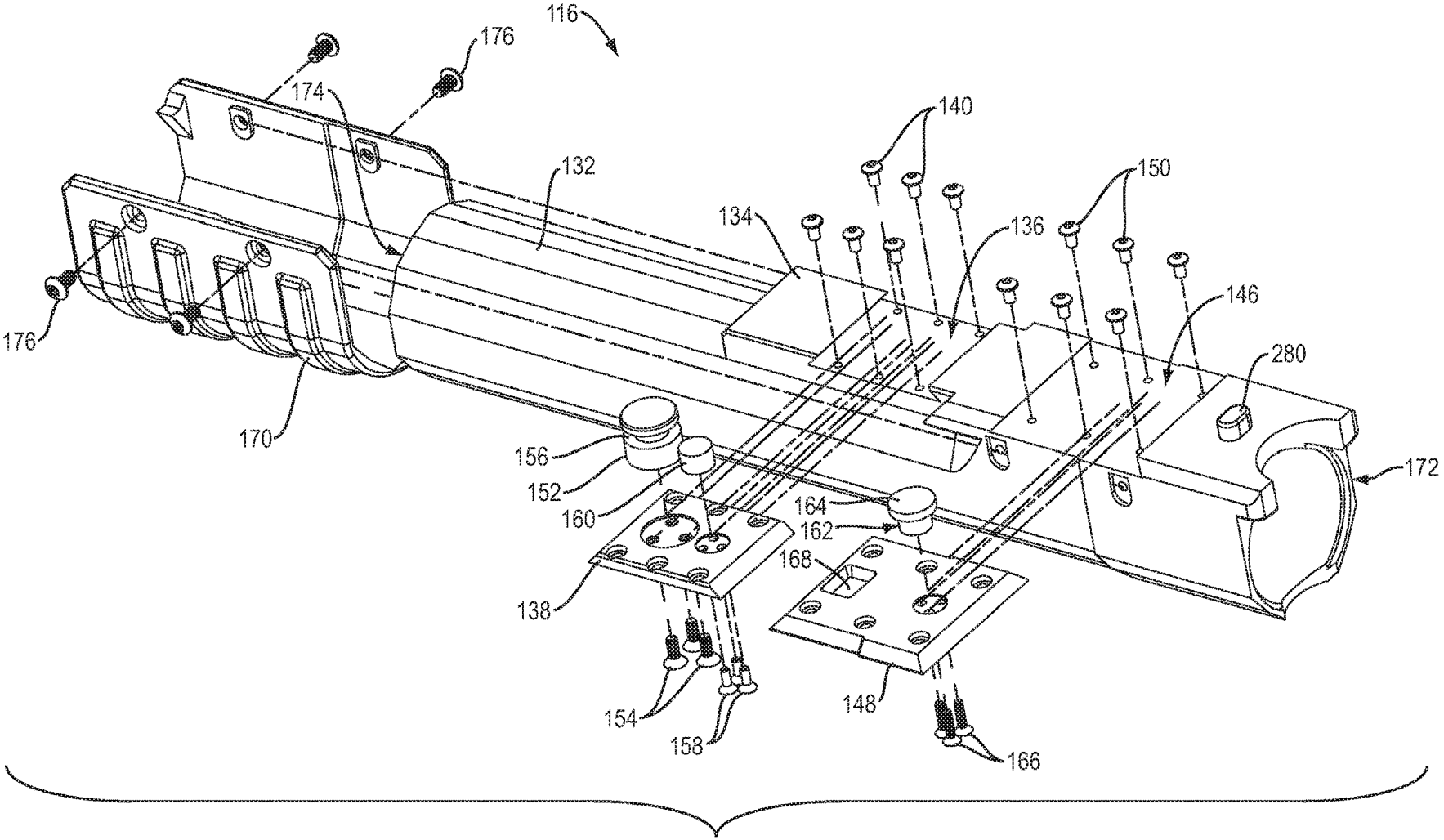
FIG. 9 is an isometric, partially exploded view of the 40 mm barrel.

As best seen in FIG. 9, the barrel assembly 116 includes a barrel 132 and a mounting surface 134 on the upper surface of the barrel. A first dovetail channel 136 is formed in the surface 134 and receives a first complementary dovetail plate 138. The first dovetail plate 138 is secured within the first dovetail channel 136 with threaded fasteners 140. A second dovetail channel 146 is formed in the surface 134 and receives a second complementary dovetail plate 148. The second dovetail plate 148 is secured within the second dovetail channel 146 with threaded fasteners 150.

A main boss 152 is secured to the first dovetail plate 138 with threaded fasteners 154. The main boss 152 includes an annular channel 156. A second boss 160 is secured to the first dovetail plate 138 with threaded fasteners 158. A third boss 162 includes an upper flange 164 and is secured to the second dovetail plate 148 with threaded fasteners 166. A hand guard 170 is secured to the lower side of the barrel 132 at a proximal end 172 thereof, opposite distal end 174, with threaded fasteners 176.

The lower chassis 112 includes a main body 130. An upper edge 133 of the main body engages a lower edge 135 of the upper chassis 110. The upper edges 133 and the lower edges 135 may include complementary fastening means, such as complementary axially extending male and female dovetail connectors, complimentary axially tongue and groove connectors, and so forth. In the preferred embodiments, the upper chassis member slidably and removably receives the lower chassis member. In such embodiments, the axially extending tongue, rib, male dovetail member, or other like protrusion, may be formed on one of the upper and lower chassis members and the channel, groove, female dovetail channel, etc. may be formed on the other one of the upper and lower chassis members. It will be recognized that the tongue, rib, male dovetail component may extend continuously along the length of the respective chassis portion, or, may be segmented along its length.

Figure 10:
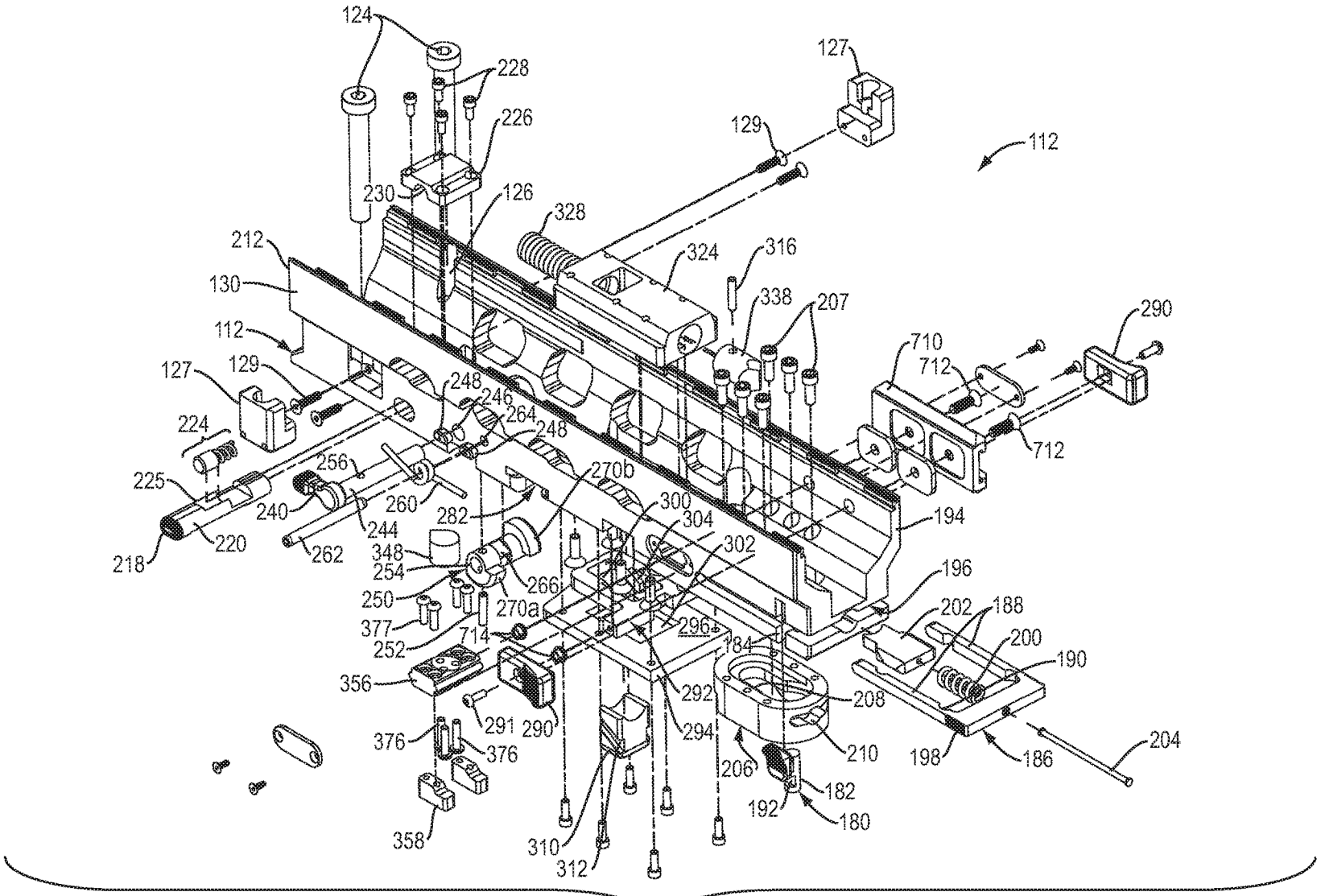
FIG. 10 is an isometric, exploded assembly view of the lower chassis.

As best seen in FIG. 10, the lower chassis 112 includes a manually actuatable release lever 180 for removing the grenade launcher barrel 116 from the lower chassis 112, e.g., for replacement with the alternative caliber barrel 142 or rail plate 144. The release lever 180 includes a locking cylinder 182 slidably received within a complementary opening 184 in the lower chassis. A serrated plate 186 includes axially extending arms 188 slidably received within an axially extending channel 196 located at the distal end 194 of the lower chassis 112 on opposite transverse sides thereof. The cylinder 182 engages a notch 190 in one of the arms 188 to secure the plate 186 in position at the distal end 194 of the lower chassis 112. Upward movement of the lever 180 brings a notch 192 in the cylinder 182 into alignment with the arm 188, allowing sliding outward movement of the serrated plate 186. Serrations 198 on the plate 186 assist the user in manually sliding the plate 186 outward to remove an attached one of the interchangeable components 320 from the lower chassis 112.

A spring 200 and a locking tooth 202 are disposed between the arms 188 within the channel 196 and are secured to the plate 186 via a pin 204. A main boss receiver 206 is secured via fasteners 207 to the underside of the lower chassis 112 and includes a generally vertically extending opening 208 for receiving the main boss 152. The tooth 202 passes through a horizontal opening 210 in the receiver 206 and normally engages the channel 156 in the main boss 152 of the barrel assembly 116 or 142 of the main boss 152*a* of the lower rail module 144.

The tooth 202 is urged by the spring 200, to secure the distal end of an attached barrel assembly or other interchangeable component in place. When the user manually presses up on the lever 180 and manually retracts the serrated plate 186, the tooth 202 disengages from the channel 156 to permit removal of the barrel assembly or other attached module from the lower chassis 112.

Figure 11:
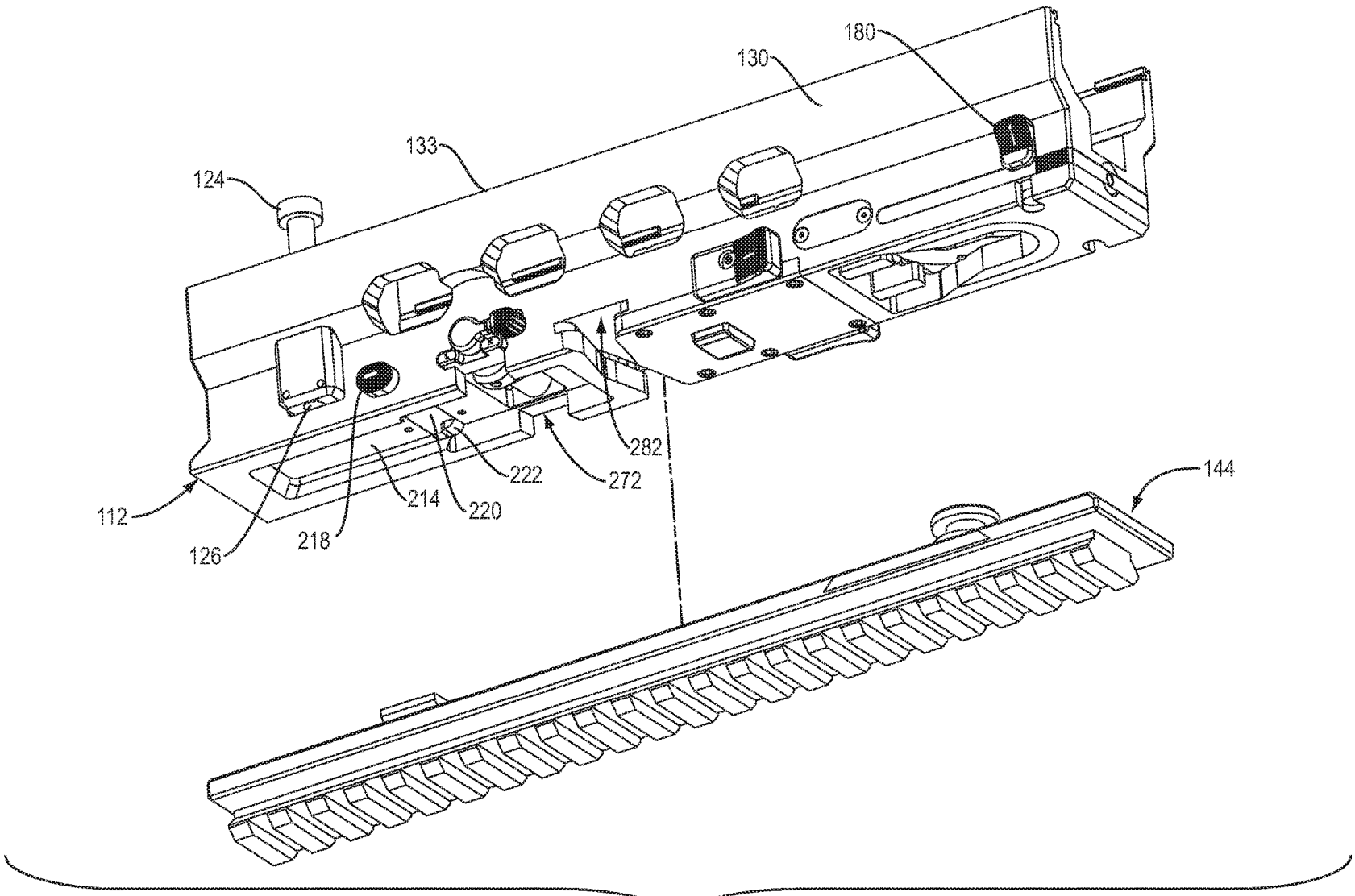
FIG. 11 is a partially exploded view illustrating the manner of interchangeably connecting a Picatinny rail section in place of the grenade launcher barrel.

The proximal end 212 of the lower chassis 112 includes a dovetail or T-slot 214 receiving channel (see FIG. 11) which slidably receives a complementary dovetail or T-shaped mounting shoe 216 (see FIG. 14) on the firing mechanism 114. A firing mechanism release button 218 includes a rod 220 having a stop member 222 (see FIG. 11) extending into the receiving channel 214. A captured spring assembly 224 resides within a notch or recess 225 formed in the rod 220 and biases the rod 220 such that the stop member 222 is positioned in the receiving channel 214 and blocks removal of the mounting shoe 216, thereby securing the firing mechanism 114 in the proximal position.

Manually pressing the button 218 against the urging of the spring assembly 224 moves the stop 222 out of the way to permit removal of the firing mechanism 114 by disengaging the mounting shoe 216 from the receiving channel 214.

When the firing mechanism release button is actuated by the user, the firing mechanism module 114 slides forward and drops out of the receiving channel 214. The rod 220 is slidably retained within the lower chassis 112 via a cover plate 226 secured to the inner floor of the channel defined by the lower chassis 112 via threaded fasteners 228, the cover plate 226 having a channel 230 formed therein receiving the rod 220.

A left/right lever 240 is manually pivotable to allow the rearward end 212 of the barrel assembly 116 to selectively pivot away from the firing mechanism 114 to either the left (see FIG. 20) or the right (see FIG. 21), as desired by the user, e.g., based on the handedness of the operator, for the purpose of chambering another round. The left/right lever is attached to a rod 244 that rotatably extends through an opening 246 in the lower chassis 112. Protrusions 248 are provided on the exterior surface of the lower chassis 112 on opposite sides of the opening 246. The protrusions act as stops to define the limits of rotation of the lever 240 and may carry indicia thereon such as "L" and "R" to indicate the side to which the barrel 116 will swing open when the sliders 290 are actuated, as detailed below.

A cam member 250 is coaxially received on the rod 244 and is secured thereto by a pin 252 passing through aligned openings 254 and 256 in the cam member 250 and rod 244, respectively. A torsion spring 260 is received about a pin 262, which in turn, is received through an opening 264, which is adjacent the opening 246. The torsion spring 260 bears against a cam surface 266 on the cam member 250 to provide an over center function to secure the lever in either the fully pivoted left or right position and to resist inadvertent pivoting of the lever 240.

Figure 20:
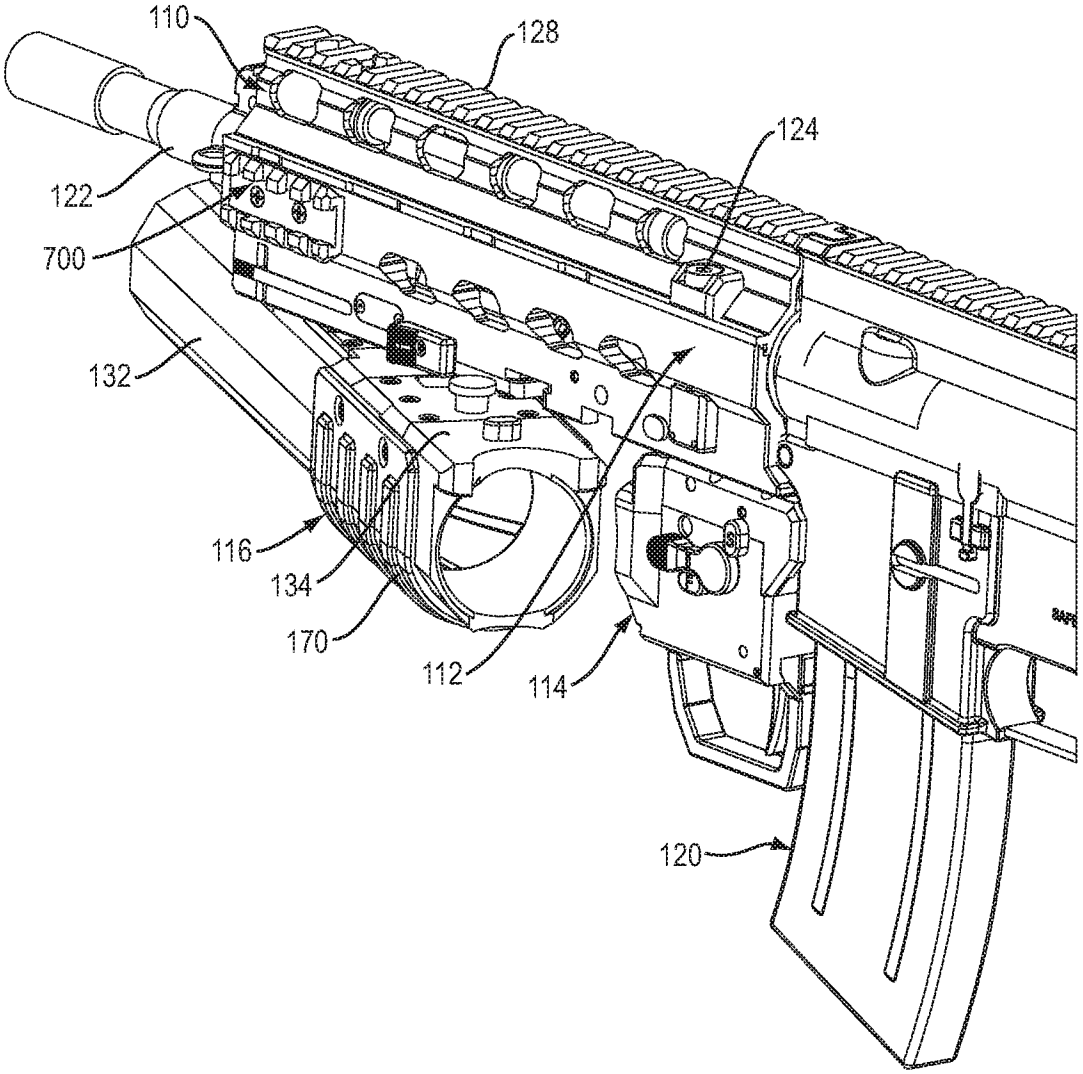
FIGS. 20 and 21 illustrate pivoting the proximal end of the grenade launcher barrel in the left and right directions, respectively.
Figure 21:
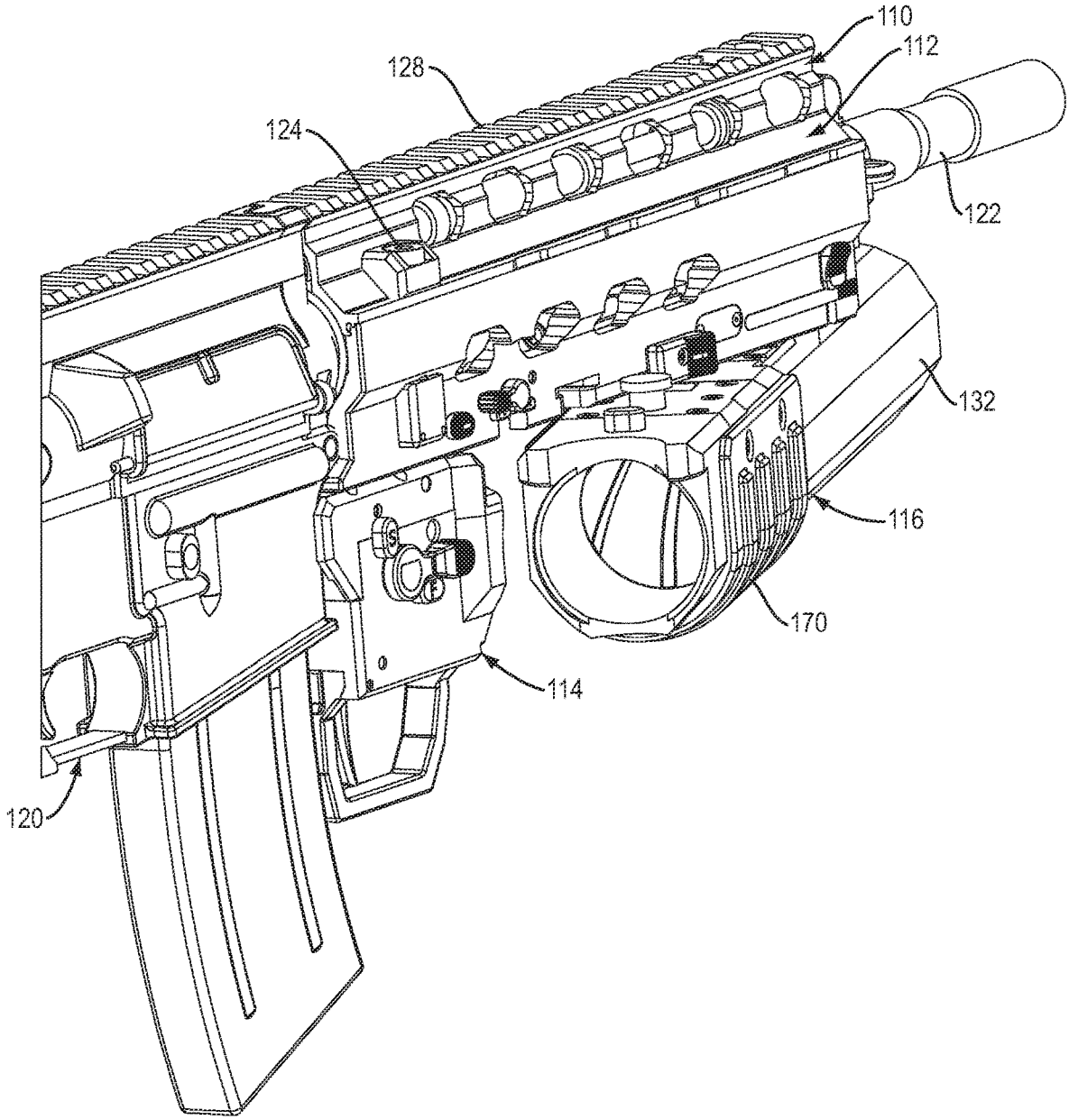
Figure 22:
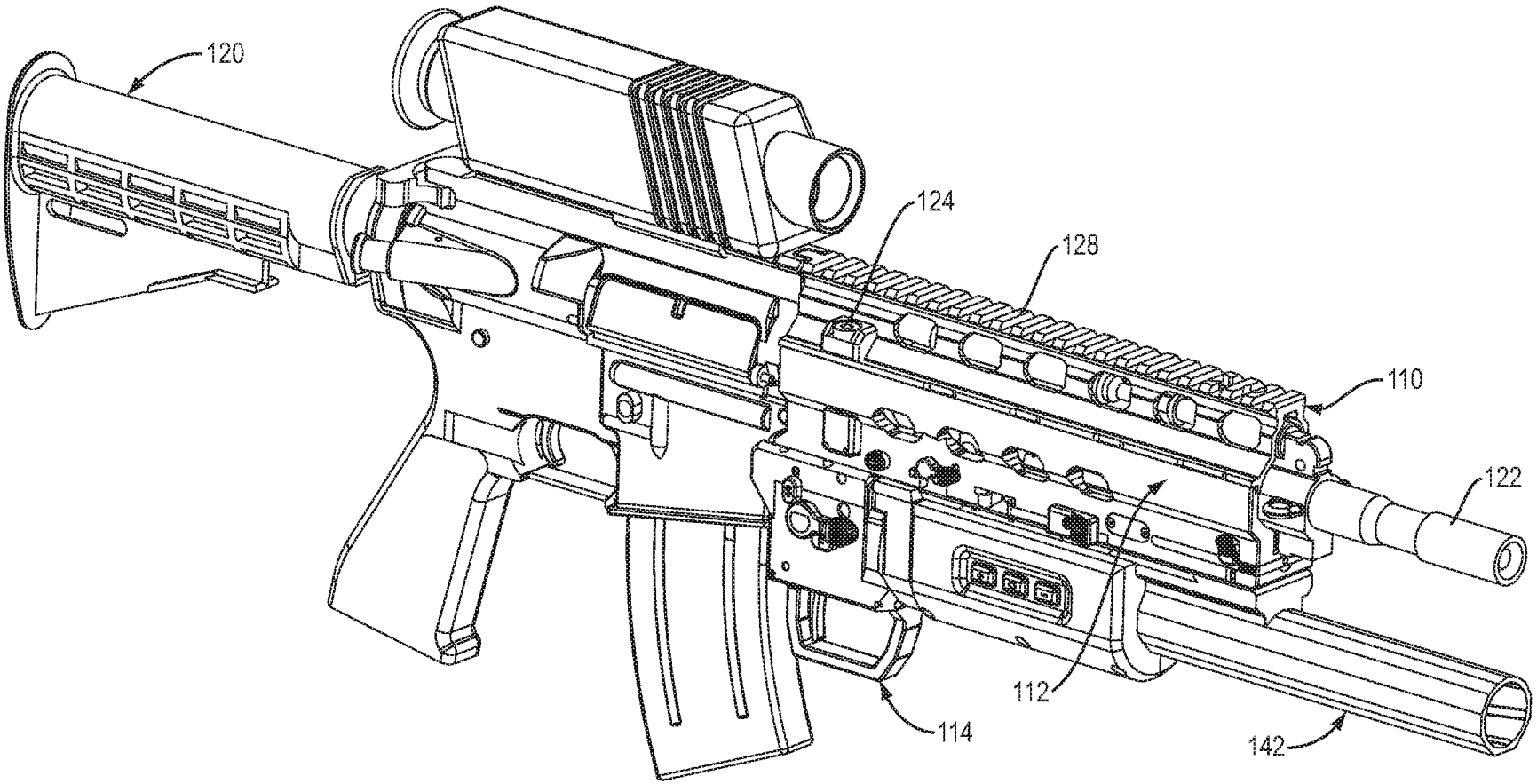
FIG. 22 illustrates an exemplary grenade launcher system employing a grenade launcher barrel assembly having electronic fire mode controls.

The outward ends of the cam member 250 include partial flanges 270*a* and 270*b*. The partial flanges are angularly displaced so that one of the flanges 270*a* and 270*b* is moved into an opening 272 (see FIG. 11) in the base of the lower chassis 112 when the lever 240 is pivoted to the "left" position and the other one of the flanges 270*a* and 270*b* is moved into the opening 272 when the lever 240 is pivoted to the "right" position. The flanges 270*a* and 270*b* selectively block movement of a protrusion 280 (see FIG. 9) on the bottom of the barrel 116 in a channel in the respective direction to permit pivoting movement of the barrel 116 about the main boss 152 in one direction only. An arcuate or angled T-slot 282 having a profile which is complementary with the boss 162 and flange 164 is provided in the lower surface of the lower chassis 112 to allow the barrel 116 to pivot in the selected direction, e.g., as shown in FIGS. 20 and 21.

Pivoting movement of the barrel is actuated by manually sliding a pair of sliders 290 which are disposed on opposite transverse sides of the lower chassis 112. Each slider 290 is attached to a respective shoulder 294 of a sliding cam 292 via a fastener 291. The sliding cam 292 is secured within the interior of the lower chassis 112 by a plate 296 and is constrained to reciprocal movement in the axial direction.

The sliding cam 292 includes a central opening 300, which is aligned with a central opening 302 in the plate 296. An engaging member 310 engages the sliding cam 292 and extends through the openings 300 and 302 and engages an opening 168 in the dovetail plate 148 (see FIG. 9) to prevent pivoting movement of the barrel 116 relative to the lower chassis 112. To pivot the barrel 116 to an open position, the sliders 290 are manually slid in the forward axial direction by the user. Movement of the sliders causes the sliding cam 292 to move forward. The sliding cam has inclined ramp surfaces 304 that engage complementary inclined features 312 on the engaging member 310. Forward sliding movement of the sliding cam 292 in the axial direction causes upward movement of the engaging member 310 to withdraw the engaging member 310 from the opening 168 and to allow the barrel 116 to pivot in the user-selected direction about the main boss 152.

A spring assisted opening mechanism for opening the barrel includes a spring 328 encapsulated in a case 324 and retained by a pin 316. The spring 328 pushes on a first cam 338, which slides against a second cam 348. The cam 348 is secured to a sliding carriage 356 via screws 377. The sliding carriage is connected to two paddles 358 via screws 376, which come into contact with the second boss of lug 160 on the barrel (see FIG. 9) to transfer the energy used to open the barrel. The transverse distance between the paddles 358 is larger than the thickness of the lug 160 to provide a small amount of play in the system which, in turn, causes the barrel to be actuated in the direction in which it was last opened.

The interchangeable, alternative caliber barrel assembly 142 includes a hand guard 170*a* and a barrel 132*a*. In certain embodiments, the barrel assembly 142 may include an electronic fire mode control system 143, e.g., of a type which may be used to program or select a firing mode of a programmable grenade or other munition round. For example, the fire mode control system may be used to program the munition round for air burst mode or impact detonation. In certain embodiments, the electronic fire mode control system 143 may be used to input a desired detonation distance to a grenade in the firing chamber. In certain embodiments, the distance traveled is tracked by determining the number of spiral rotations the grenade undergoes after it is fired. The present system may be used in conjunction with a range finder, such as an optical range finder, and the electronic fire mode control system 143 is used for inputting determining the distance to the target. In certain embodiments, the barrel assembly may be compatible with the XM25 grenade launcher platform.

As shown, for example, in FIG. 4, the alternative barrel assemblies such as the barrel assembly 142 will have a like mounting surface 134 and similar retention and pivot components thereon, which may be as described above in connection with the barrel assembly 116. The lower accessory rail module 144 replaces the barrel assembly 116 or 142 and the firing mechanism 114 and does not pivot. The upper (in the orientation shown) surface of the lower rail module 144 includes a main boss 152*a* secured to a dovetail 138*a* received within a complimentary dovetail channel 146*a* formed in the rail member 144. The main boss 152*a* is removably received with the main boss receiver 206 of the lower chassis as described above to removably secure the forward end of the rail member 144 to the lower chassis. The lower rail member 144 further includes and a dovetail or T-shaped mounting shoe 216*a* on the upper surface thereof, which is slidably received in the receiving channel 214 to removably secure the rearward end of the rail member 144 to the lower chassis.

With reference now to FIGS. 6, 7, 12, and 13, there appears a further embodiment wherein the modular grenade launcher system herein may be configured for use as a standalone weapon, i.e., without an associated firearm. The standalone configuration includes a frame comprising a fore end portion and a buttstock portion. The illustrated preferred embodiment depicts a preferred embodiment wherein the fore end portion and the buttstock portion are hingedly coupled, which allows the unit to be folded for storage and transport. It will be recognized, however, that nonfolding frames are also contemplated, e.g., wherein the buttstock portion and the fore end portion form an integral or unitary structure or are rigidly or non-foldingly attached to each other.

In the depicted embodiment, an upper chassis 110*a* s coupled to fore end assembly 330 via a guiding member 332 and fasteners 334. A proximal end of the fore end assembly 330 includes a hinge assembly 340. The hinge assembly 340 includes a hinge body 342 pivotally attached to a pivot plate 344 via a hinge pin 346. A lower chassis 112 is attached to the upper chassis 110*a* via fasteners 124. The lower chassis 112 and the barrel assembly pivot and release features may be as described above.

The fore end assembly 330 includes a pair of rods 350 extending from the distal end 343 of the hinge body 342. The rods 350 pass through openings 352 in fasteners 336. The fasteners 336, in turn, are secured to the upper chassis 110*a* via threaded fasteners 354. An end cap 360 is secured to the end of the upper chassis 110*a* via fasteners 362. A half sleeve 364 is received about a shallow annular channel 366 in each of the rods 350 and is secured in place with a pin 368 passing through aligned openings in the corresponding rods and sleeves. The half sleeve members 364 protrude from the respective channel 366 and abut one of the fasteners 336 to provide a rigid connection and prevent relative axial movement between the upper chassis 110*a* and the fore end assembly 330, e.g., as a result of recoil when a round is fired from an attached grenade launcher barrel 116 or 142.

The guiding member 332 includes first and second setscrews 380 rotatably received within threaded openings 382 on opposite transverse sides of the member 332. Bearing members 384 are positioned between each of the setscrews 380 and a respective side surface 386 of the hinge body 342. The guiding member 332 also includes a third setscrew 390 rotatably received within a threaded opening 392 in the clamp 332. A bearing member 394 is positioned between the setscrew 390 and a lower surface 396 of the hinge body 342. The setscrews 380, 390 can be advanced or retracted as necessary to adjust for any play in the gap between the guiding member 332 and the respective adjacent surfaces 386, 396 of the hinge body 342.

A buttstock assembly 370 includes an end plate 372 which is attached to the pivot plate 344 with fasteners 374. The hinge assembly 340 includes a latch assembly for securing in the operable or unfolded position and releasing the hinge assembly for folding the buttstock relative to the fore end assembly. The latch assembly includes a push button 410 which is biased upward by a spring 412. A latch member 420 is pivotally attached to the hinge body 342 on a side opposite the hinge pin 346 via a pin 422 to secure the hinge in the closed position. The hinge pin 346 passes through a channel 430 defined by interfitted knuckles on the hinge body 342 and the plate 344.

The hinge pin includes an upper head or flange portion 440. The lower end of the hinge pin 346 includes a slot 432 extending in the direction of the pivot axis. A spacer 434 is received at the lower end and a lower head or flange member 450 is secured to the pin 346 and spacer 434 with a pin 436 flush with the lower end of the hinge pin 346. The length of the spacer 434 is less than the length of the slot to define an opening 460 in the hinge pin 346. Notches 462 and 464 in the knuckle portions of the hinge body and hinge plate cooperate to define an opening that is aligned with the opening 460 when the hinge is in the closed position.

A lever 500 is captured within an opening 510 in the hinge body 342 and is pivotally rotatable about a threaded fastener 512. The lever 500 is secured by a cover plate 514 via fasteners 516. The lever includes a projection 520 that is received within the opening 460 and the opening defined by the notches or cutaway portions 462 and 464 to prevent pivoting of the buttstock 370 relative to the fore end assembly 330. In operation, to fold the buttstock assembly 370 relative to the fore end assembly 330, the release button 410 is manually depressed against the urging of the spring 412. The lower end of the button 410 bears against a projection 415 on the lever 500 to move the projection 520 out of the opening defined by 460, 462, 464 to permit folding of the hinge assembly.

Figure 12:
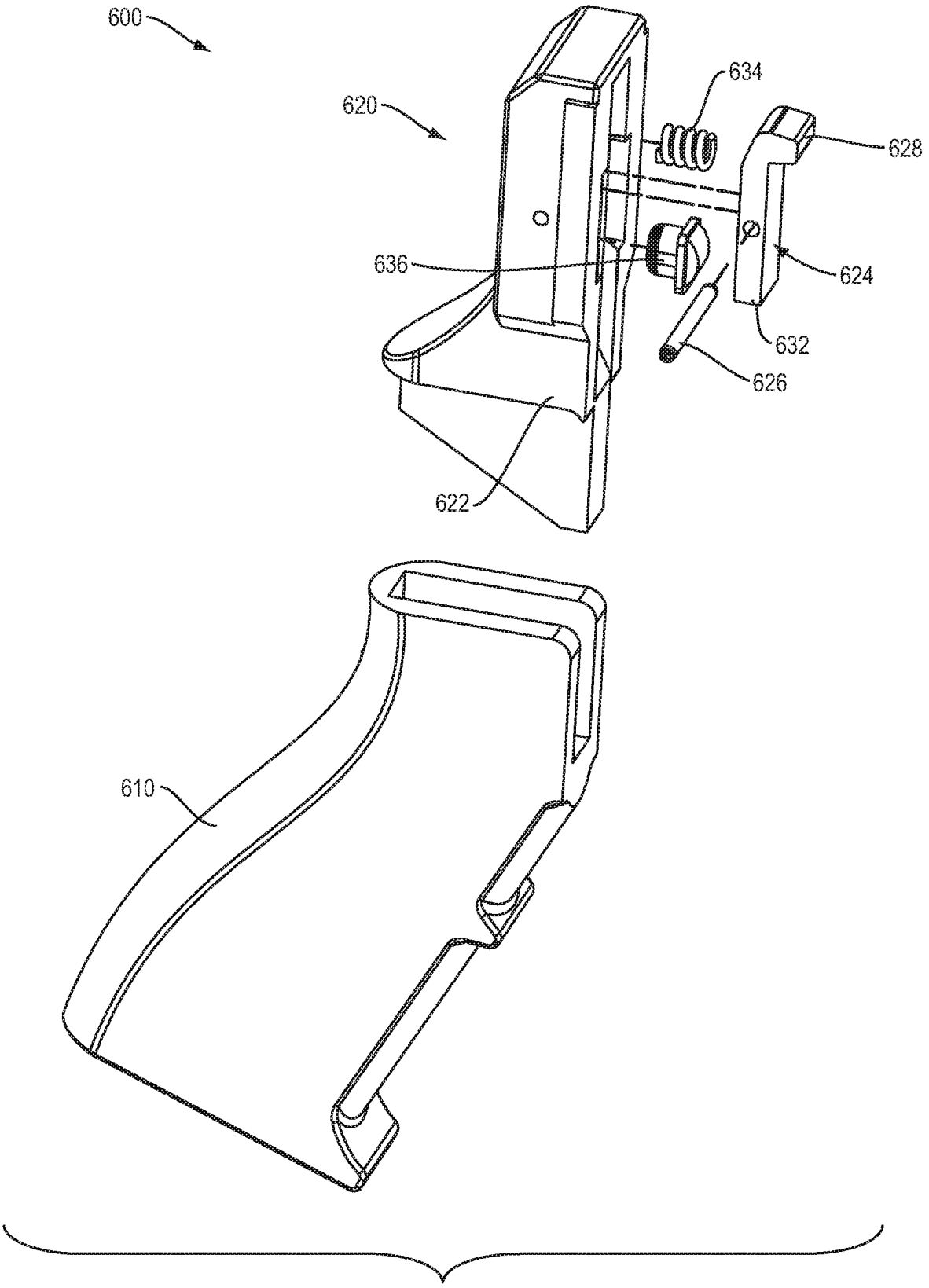
FIG. 12 is an exploded view of a pistol grip used in connection with the trigger assembly.
Figure 13:
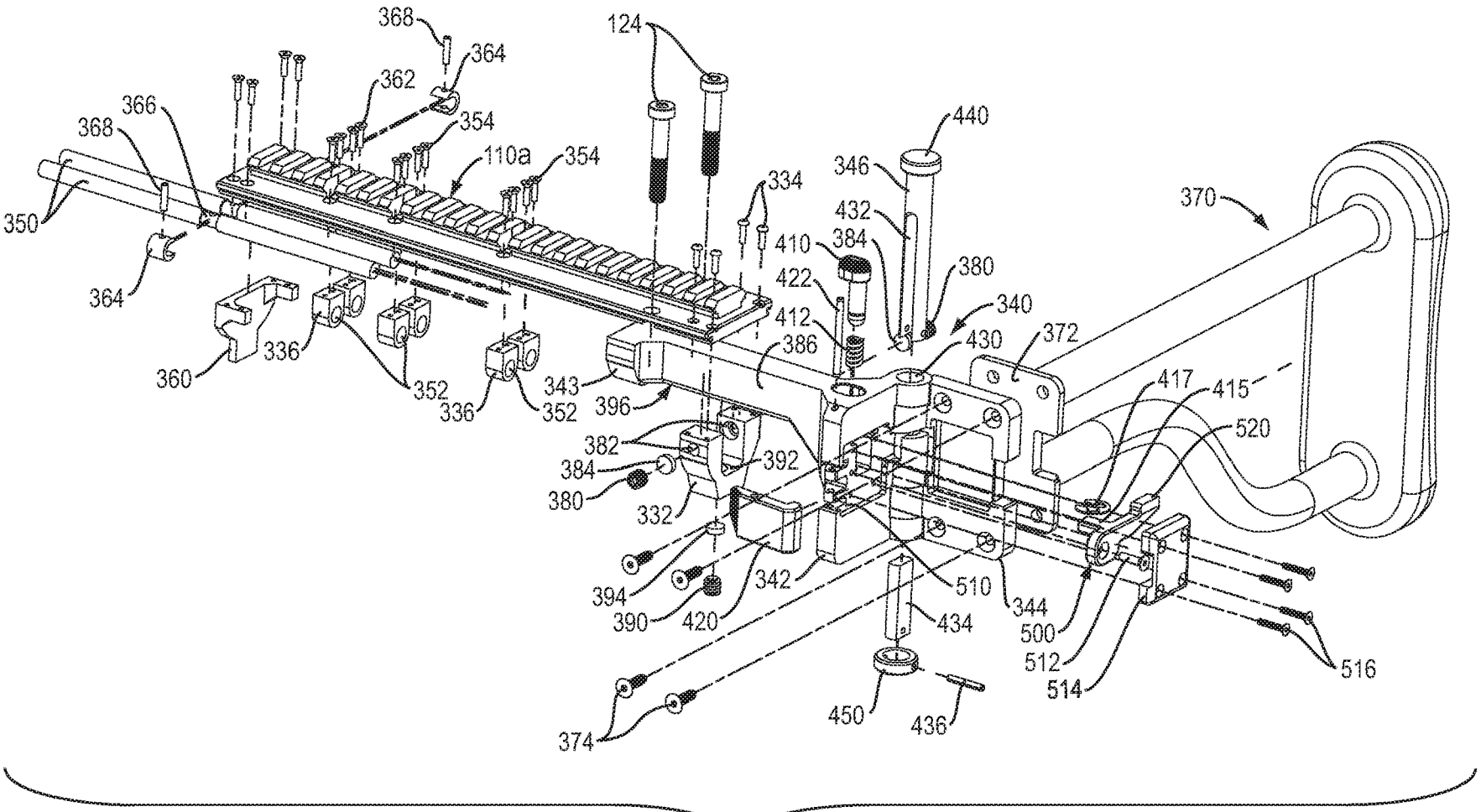
FIG. 13 is an exploded view of the buttstock assembly herein.

As best seen in FIG. 12, a handgrip assembly 600 includes a handgrip member 610 and a fastener assembly 620 for removably securing the handgrip assembly 600 to the firing mechanism 114. The handgrip 610 may be a commercially available handgrip. The fastener assembly 620 includes a housing 622 and a pivoting latching member 624 pivotally secured in the housing 622 with a pin 626. The latching member 624 includes a tooth 628 that removably engages a complementary receptacle 630 (see FIG. 7) on the firing mechanism and a lever 632. A captured spring 634 within the housing 622 urges the tooth 628 into engagement with the receptacle 630. A button 636 extends through an aligned opening in the housing and bears against the lever 632. Manually depressing the button 636 pivots the lever 632 to compress the spring 634 and disengages the tooth 628 from the receptacle 630 to release the handgrip assembly 600 from the firing mechanism 114.

Figure 23:
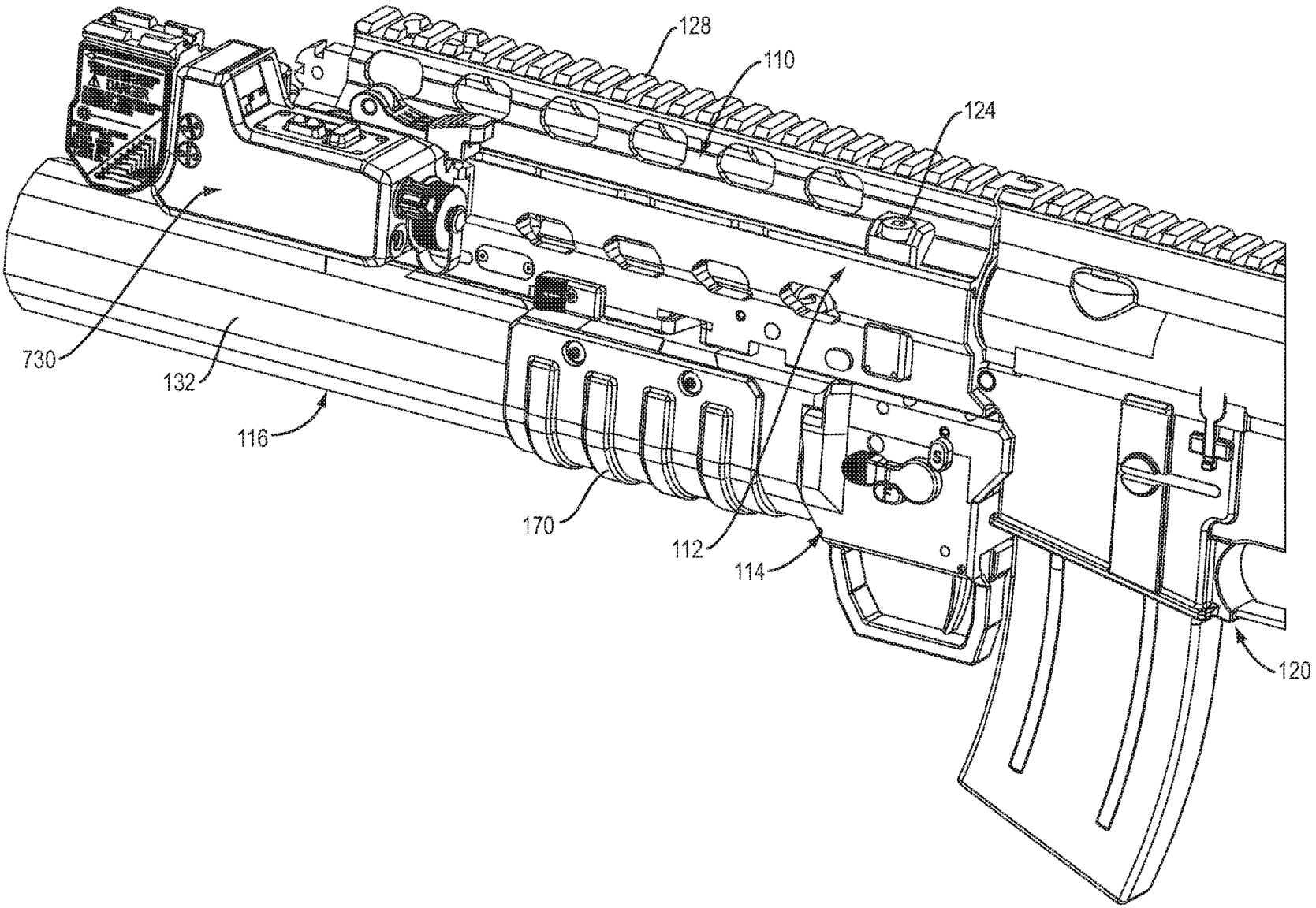
FIG. 23 illustrates an exemplary grenade launcher system herein employing a grenade launcher barrel assembly and used in conjunction with a ballistics computer or fire control system.

A side accessory rail assembly 700 includes a side rail section 710 secured to a sidewall 130 of the lower chassis 112 via threaded fasteners 712 and nuts 714. The rail section 710 may be a Picatinny rail section or the like and may be used to mount an accessory device such as a ballistics computer or fire control system 730, as shown in FIG. 23, or other accessory, such as a sighting device, range finder, laser designator, illuminator, camera, or the like.

Figure 14:
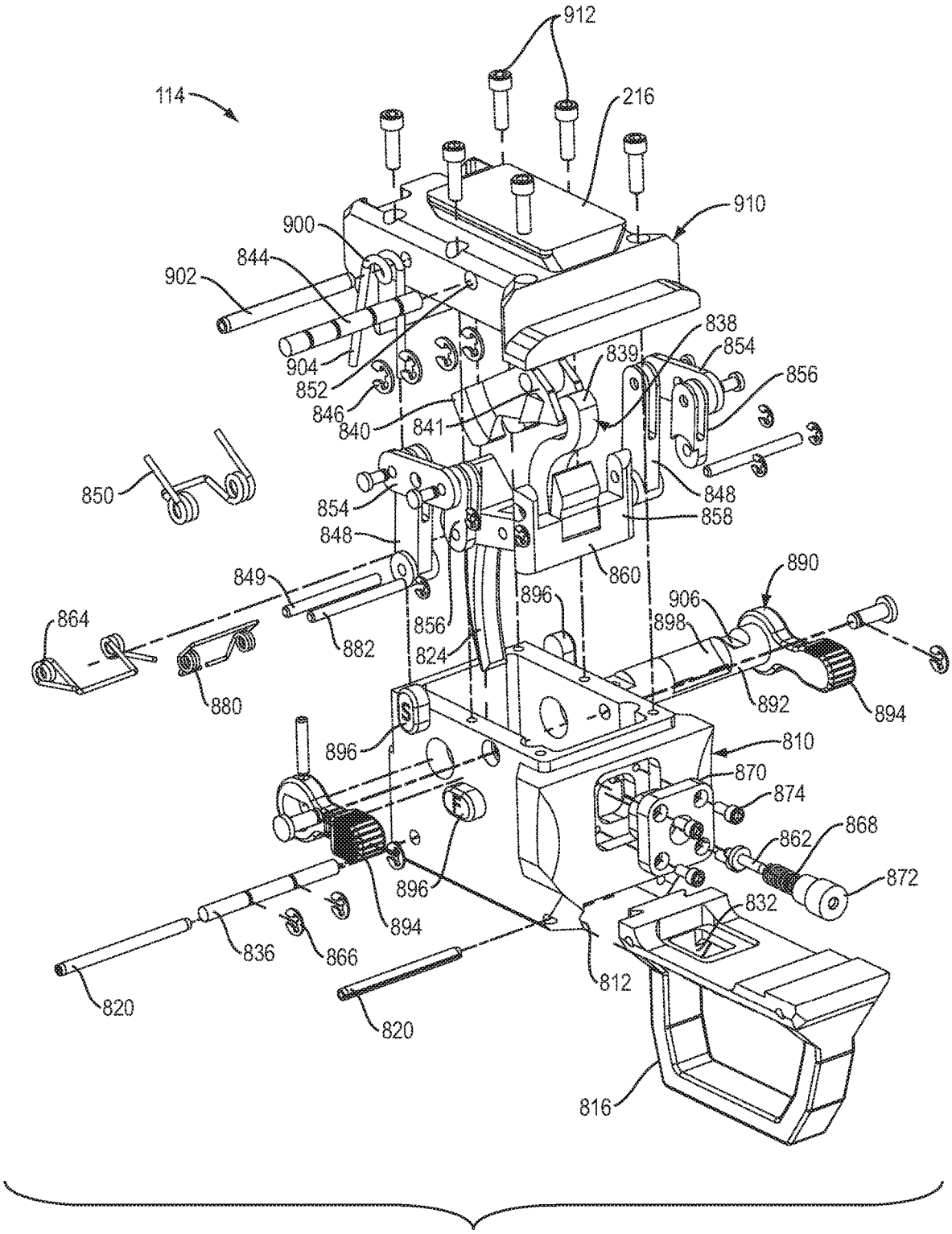
FIG. 14 is an exploded view of the firing mechanism.

Referring now to FIG. 14, the firing mechanism 114 includes a housing 810 having a T-channel 812 formed at the bottom thereof for slidably receiving a complementary trigger guard 816 secured within the channel 812 via pins 820. The trigger 824 extends through an opening 832 in the trigger guard 816 and is pivotal about a pin 836.

The trigger 824 is coupled to a sear 838 releasably engaging a hammer 840. The sear 838 includes a curved or hooked distal end 839 which engages an indent or cavity 841 in the hammer 840. The hammer is pivotally mounted within the housing 810 on a slotted pin 844, which is retained within the A hammer spring 850 is received on the pin 844 which is retained in position in openings 852 in a firing mechanism cover 910 by clips 846.

As the trigger 824 is depressed, it simultaneously pulls down on the sear 838 and trigger linkages 848 on opposite transverse sides thereof and held together via linkage pin 849. The sear 838 retracts the hammer 840 and compresses the spring 850 by pulling on the indent 841 until the sear point falls off the edge of the hammer indent 841, at which point the trigger is released and powered forward by the hammer spring 850.

Figure 15:
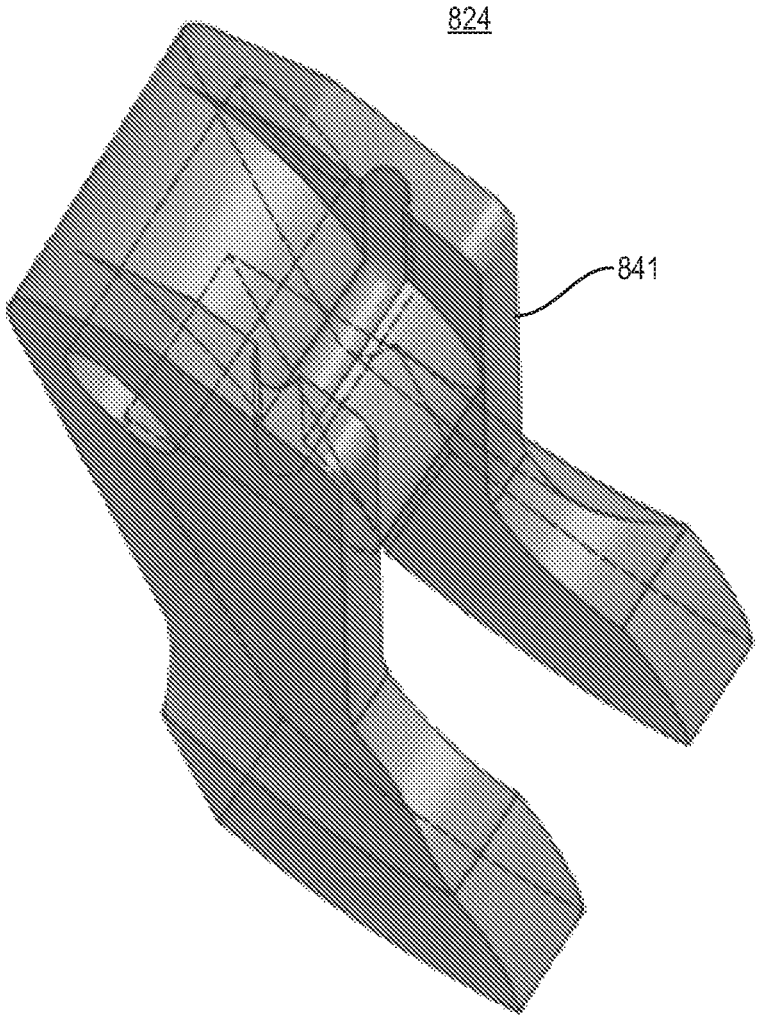
FIG. 15 is an isometric view of the hammer
Figure 16:
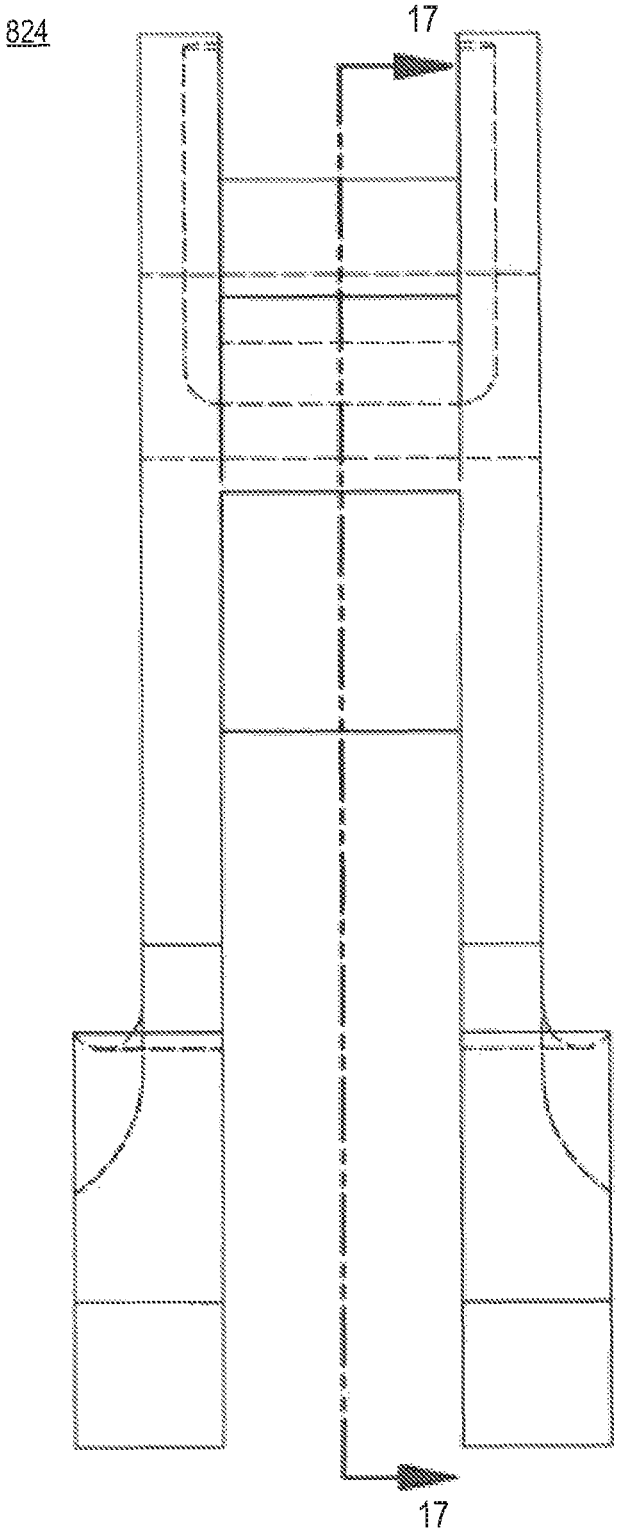
FIG. 16 is an end view of the hammer 840.
Figure 17:
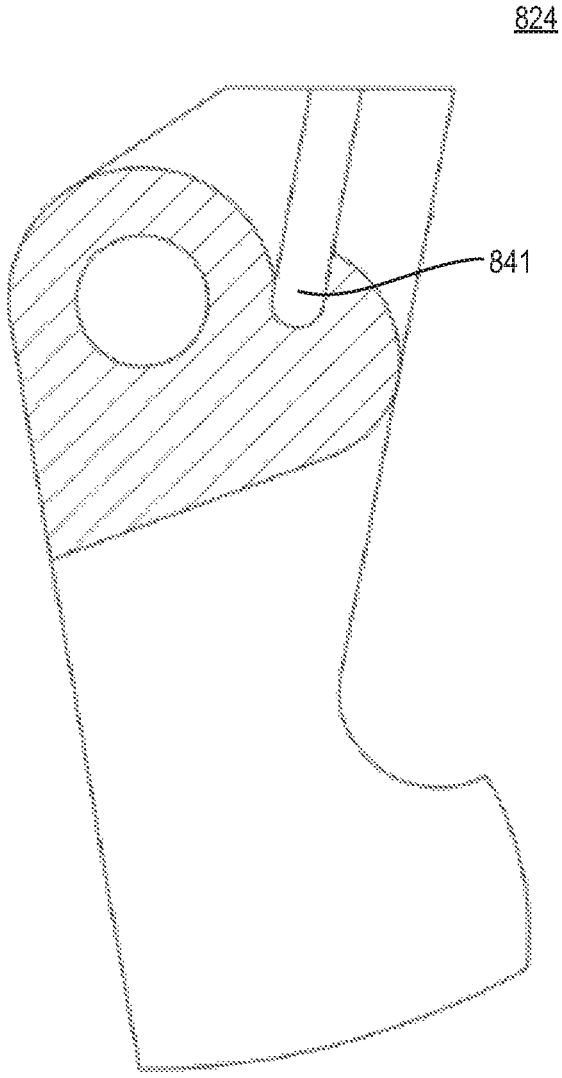
FIG. 17 is a side cross-sectional view of the hammer taken along the lines 17-17 appearing in FIG. 16.
Figure 18:
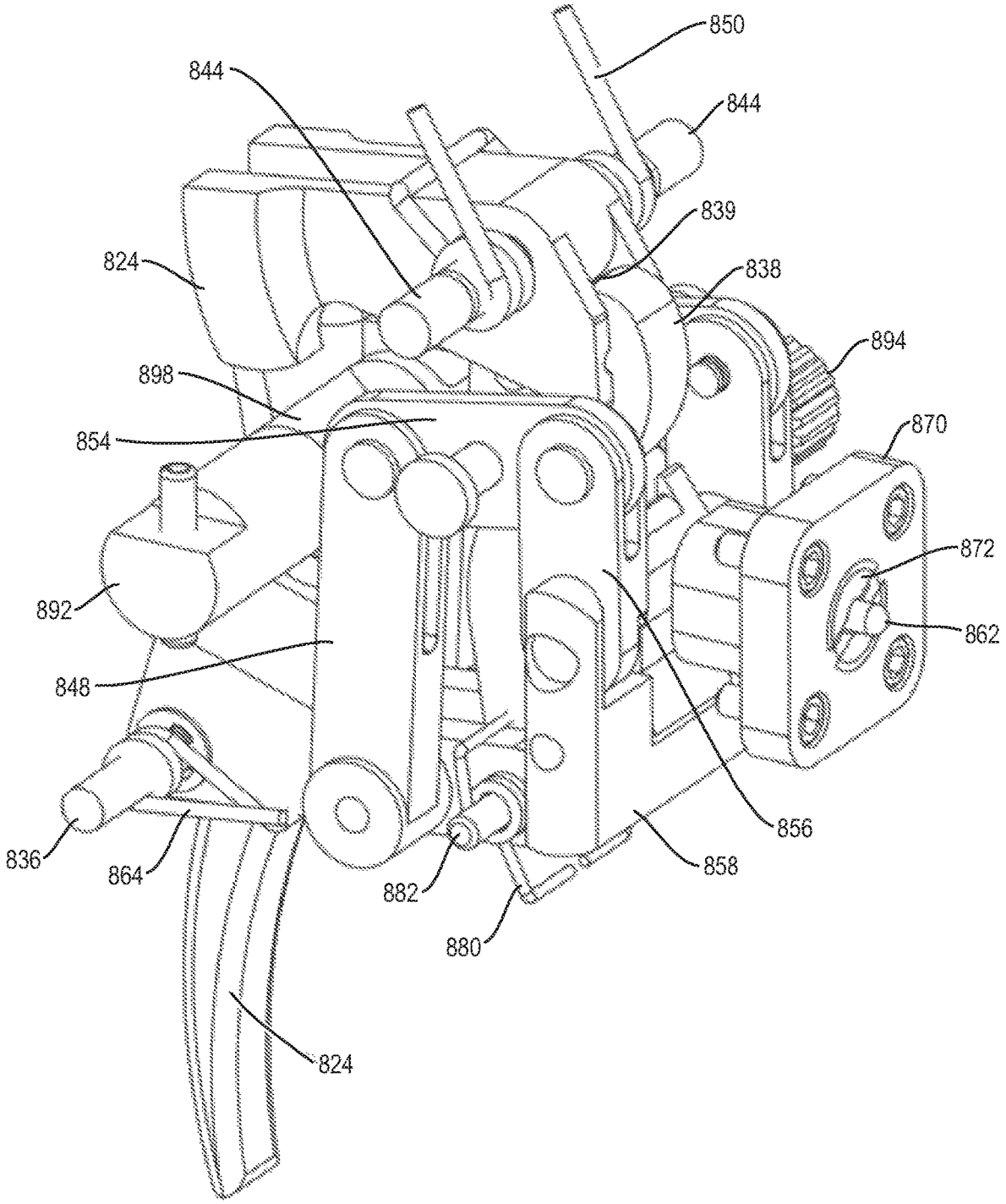
FIG. 18 illustrates the trigger and hammer assembly when the hammer is about to drop, i.e., wherein the trigger is about 90% depressed.
Figure 19:
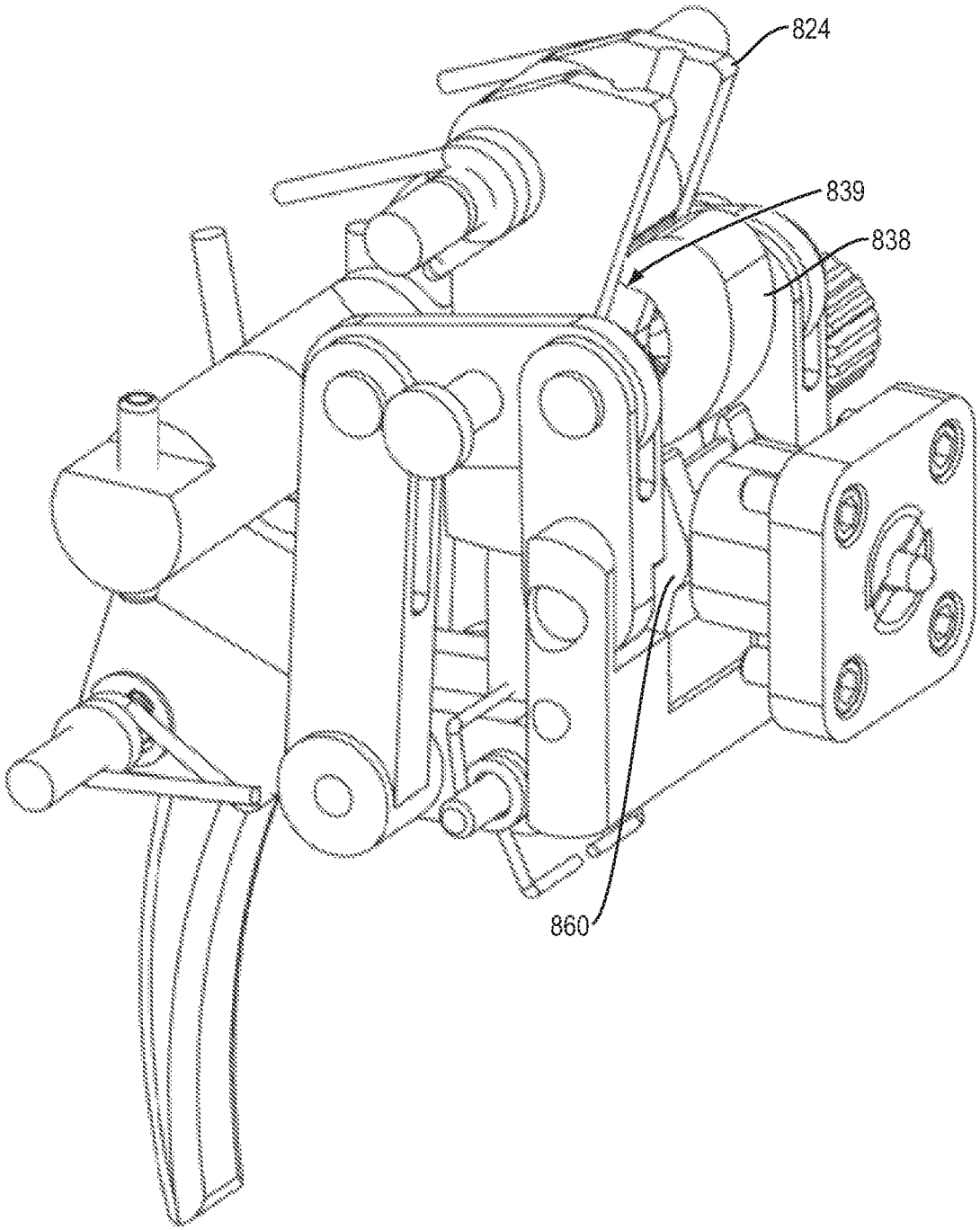
FIG. 19 illustrates the trigger and hammer assembly after the hammer has dropped.

FIG. 15 is an isometric view of the hammer 840. FIG. 16 is an end view of the hammer 840. FIG. 17 is a side cross-sectional view of the hammer 840 taken along the lines 17-17 appearing in FIG. 16. FIG. 18 illustrates the trigger and hammer assembly when the hammer is about to drop, i.e., wherein the trigger is about 90% depressed. FIG. 19 illustrates the trigger and hammer assembly after the hammer has dropped.

Each trigger linkage 848 is pivotally coupled to a connecting linkage 854, which, in turn, transfers movement via a slide linkage 856 and a flipper slide 858 to a hammer disconnect plate 860. The hammer disconnect plate 860 is a flipper that transfers energy to from the hammer 840 to a firing pin 862, which extends through an opening in a firing pin retainer 872 in a firing pin housing 870. The firing pin housing is secured to the front surface of the housing 810 via fasteners 874.

A trigger return spring 864 is received on the pin 836, which is retained by clips 866. When the trigger 824 is released, the trigger return spring 864 returns the trigger 824 to the forward position. The flipper 860 the lowers to provide a gap between the hammer 840 and the firing pin 862, which in turn, allows the firing pin 862 to retract via the rearward urging of a firing pin return spring 868. A sear return spring 880 is received on a linkage pin 882 and returns the sear 838 to the hammer indent 841.

A manual safety mechanism is also provided to prevent accidental discharge of the weapon and includes a safety catch 890 having a transverse rod portion 892 extending through openings in the housing 810. Levers 894 are provided to manually rotate the safety between a safe position and a firing position. Indicia 896 are provided on the housing 810 to allow the user to visually determine whether the safety is on or off.

The rod portion 892 includes a slot 898 which allows the hammer to retract therethrough when the safety lever is pivoted to the forward position. Pivoting the rod 892 to the upward or safe position moves the rod into the path of the hammer so that the hammer is unable to retract, thereby preventing discharge of the weapon. Safety detent springs 900 are received about a spring pin 902. The springs 900 are torsion springs a having a forward leg 904 which is received within a corresponding and aligned detent or slot 906. The legs 904 bear against the respective slot 906 to hold the safety mechanism in position.

The firing mechanism cover 910 is secured to the top of the housing 810 via fasteners 912. The cover plate includes the dovetail shoe 216 that is slidably received within the receiving channel 214 in the lower chassis 112.

Figure 24A:
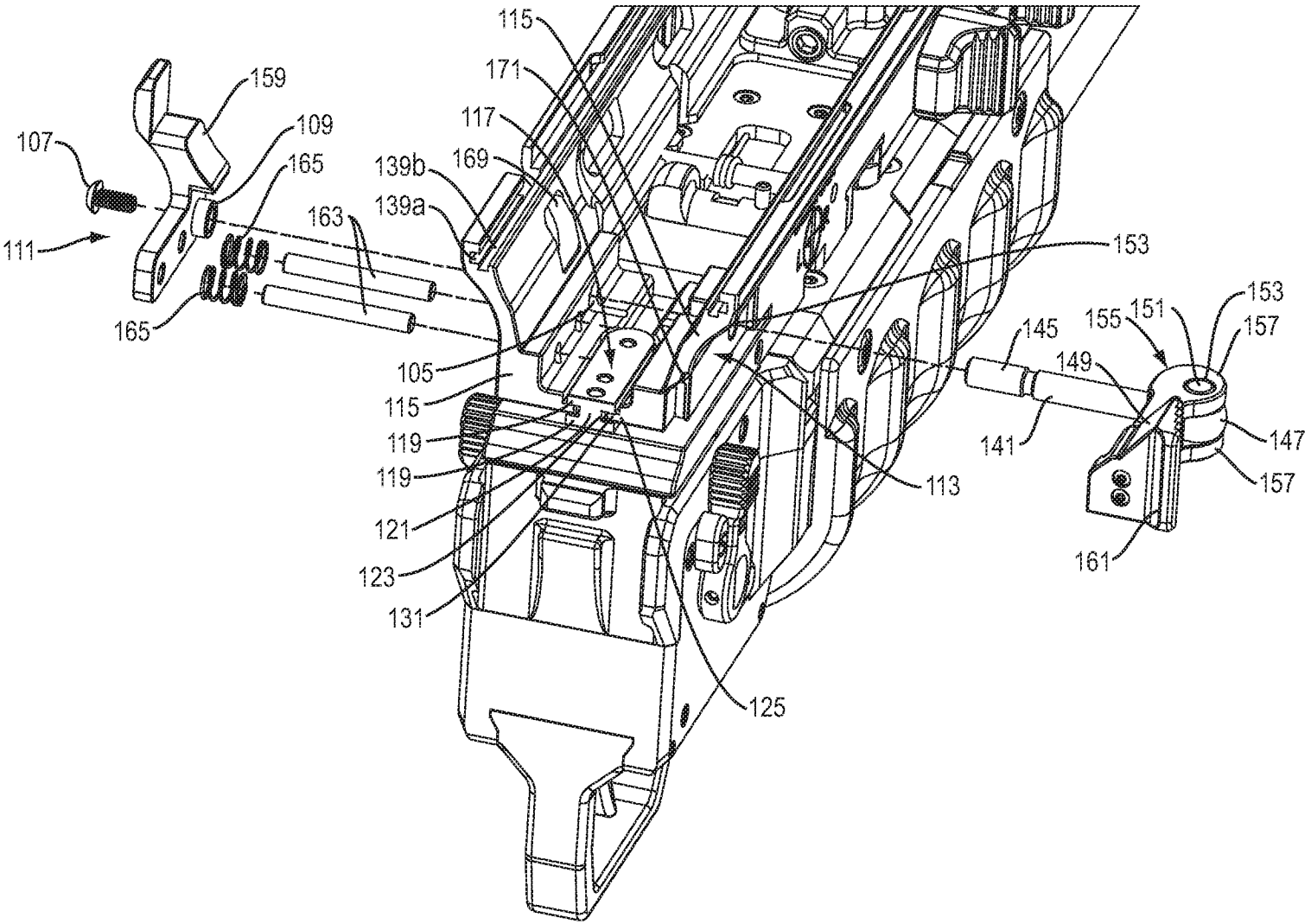
FIG. 24A is a fragmentary perspective view of an alternative embodiment grenade launcher system illustrating an alternative fastener for securing the chassis to the firearm appearing in exploded view.
Figure 24B:
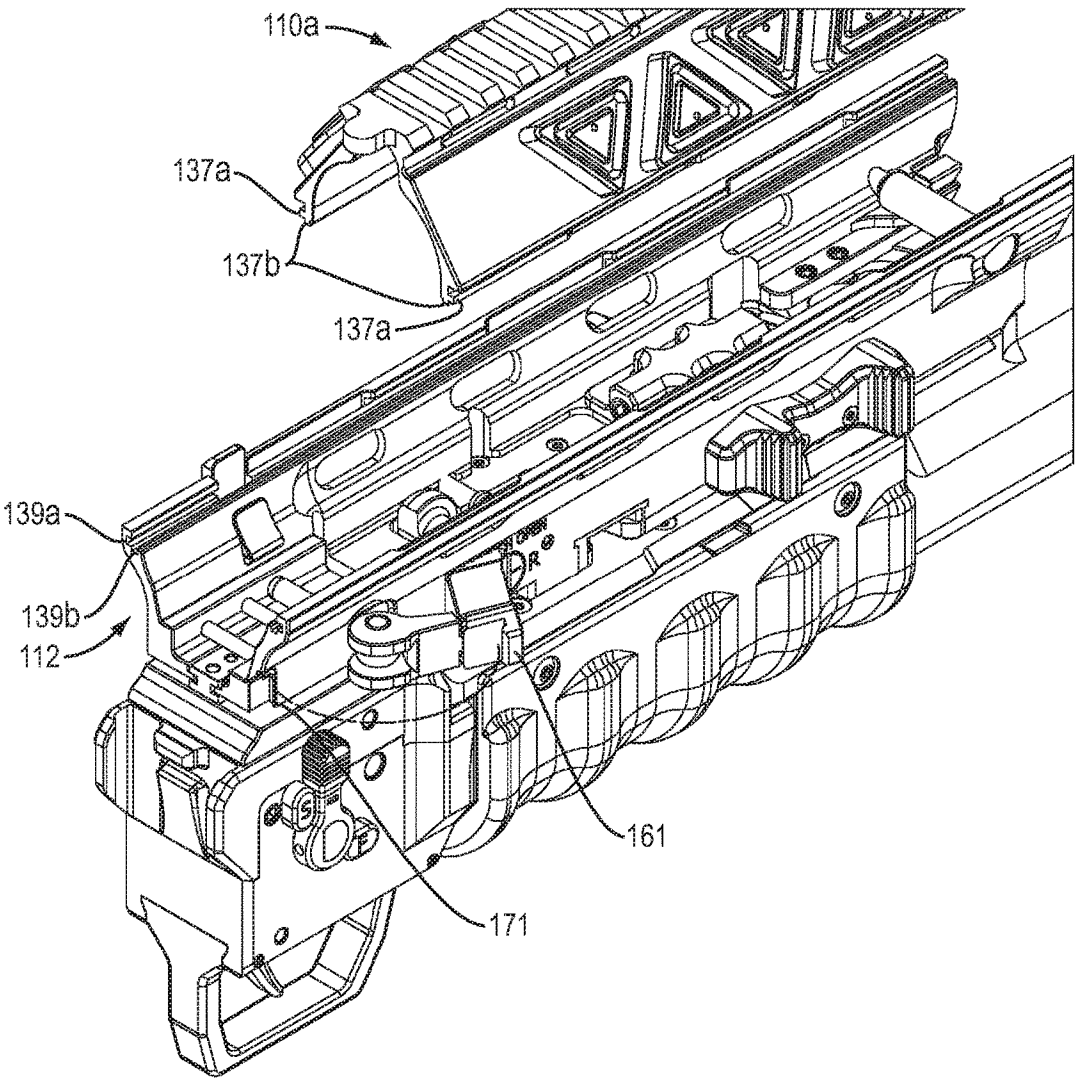
FIG. 24B is a partially exploded, fragmentary perspective view of the alternative embodiment grenade launcher system appearing in FIG. 24A.
Figure 24C:
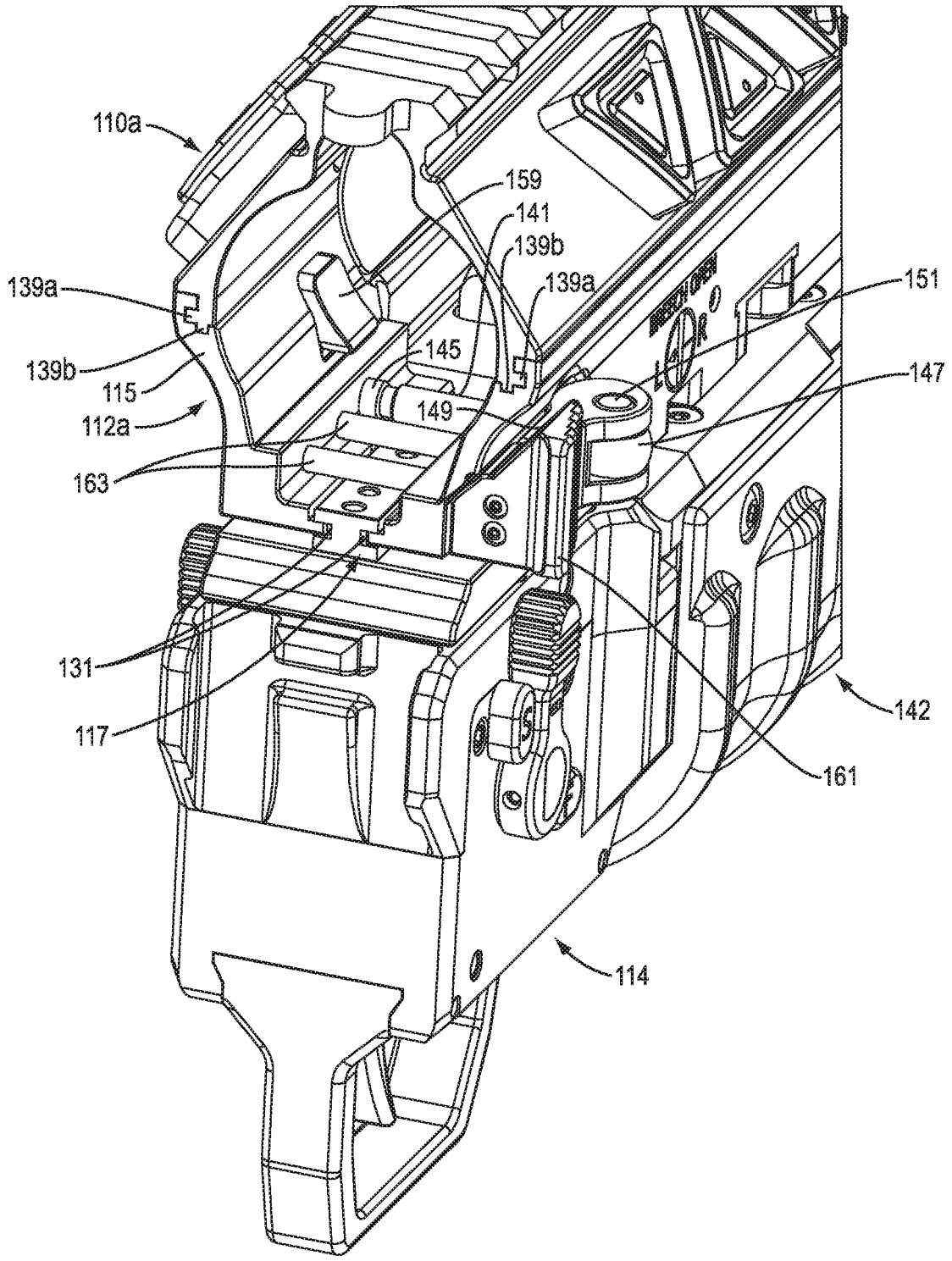
FIG. 24C is a perspective view of the alternative embodiment grenade launcher system appearing in FIGS. 24A and 24B.

Referring now to FIGS. 24A-24C, there appears an alternative embodiment of the grenade launcher system which employs an alternative fastener for attaching the chassis to the firearm and a preferred dovetail configuration for securing the upper and lower chassis members. The embodiment appearing in FIGS. 24A-24C includes an upper chassis member 110*a* engaging a lower chassis 112*a*. The upper chassis 110*a* includes lower edges on opposite transverse sides having a plurality of axially extending tongues 137*a* and 137*b*. The lower chassis 112*a* includes lower edges on opposite transverse sides having a plurality of axially extending grooves 139*a* and 139*b* which are complimentary with the tongues 137*a* and 137*b*, respectively.

The lower chassis 112*a* includes a distal end 113 having opposing, axially extending arms 115. The distal end 113 includes an expansion joint defined by the arms 115 and a central expansion member 117 therebetween. The expansion member has a generally "I" shaped cross-sectional shape and includes upper and lower horizontal, axial flanges 119 and a vertical, axial web 121 extending therebetween, thereby defining channels 123 between the flanges 119. The arms 115 each include and axial tongue 125 extending into a respective one of the channels 123. The tongues 125 and channels 123, 123 are dimensioned to define clearance or gaps 131 to allow a degree of movement between the arms 115.

The fastener includes a drawbar 141 having a first, threaded end 145 rotatably engaging a tapped opening or boss 109 of a clamping member 111 in the lower chassis portion 112*a*. The drawbar 141 passes through openings in the sidewalls of the lower chassis 112*a* and also includes a second end 147 opposite the first end. A lever arm 149 is pivotally attached to the second end 147 via a hinge or pivot pin 151. The pivot pin 151 passes through an opening 153 whereby the proximal end 155 of the lever arm 149 defines one or more cam surfaces 157.

The cam surfaces 157 are eccentrically shaped, e.g., wherein the cam surfaces 157 have a radius of curvature wherein the opening 153 is positioned off center with respect to the radius of curvature. The lever arm 149 is pivotable between a locked position as shown in FIGS. 24A and 24C and an unlocked position as shown in FIG. 24B. In the locked position, the distance between the pivot pin 151 and the cam surfaces 157 is increased to thereby draw the clamping member 111 inward. A tooth or protrusion 159 passes through an opening 169 on the lower chassis portion 112*a* and is moved into engagement with a like depression or channel on the barrel nut on the firearm when the lever arm is moved to the locked position to exert a clamping force on the barrel nut of the firearm. Clamping pressure between the clamping member 111 and the cam surfaces 157 may also cause the arms 115 to move toward each other to close the clearance or gap 131, thereby increasing the clamping force of the lower chassis member 112*a* on the firearm. Pivoting the lever arm 149 to the unlocked position causes the distance between the pivot pin 151 and the cam surfaces 157 to decrease, to allow the clamping member 111 to move away and release the clamping force on the barrel nut of the firearm.

Movement of the lever arm 149 to the unlocked position also allows the user to rotate the drawbar with respect to the tapped opening 109 in the lower chassis member 112*a*. Rotation of the drawbar 141 with respect to the tapped opening 109, in turn, allows the user to adjust the clamping force exerted when the lever arm is subsequently moved to the locked position. A threaded fastener 107 having an enlarged head engages the threaded end 145 through an opening 105 in the lower chassis portion 112*a* to prevent the drawbar 141 from completely disengaging with from the clamping member 111.

The clamping member 111 is carried on one or more pins 163 extending transversely between the opposing arms 115. The pins carry biasing springs 165 thereon for urging the clamping member 111 outward and out of registration with the barrel nut to facilitate removal of the chassis from the firearm when the lever arm 149 is moved to the unlocked position. The arms 115 are movable in the transverse direction with respect to the pins 163.

In certain embodiments, the lever arm 149 may optionally include a locking tab 161 on the distal end thereof. The locking tab 161 is movable with respect to the lever arm 149 and may be biased (e.g., via a captured internal spring or other resilient biasing member, not shown) to engage a complimentary feature 171 on the lower shell 112*a*. In such embodiments, the user must manually disengage the tab 161 from the complimentary feature 171, against the bias of the biasing member, in order to move the lever arm 149 from the locked position to the unlocked position. In this manner, inadvertent movement of the lever arm 149 from the locked position to the unlocked position can be avoided or minimized.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A barrel-interchangeable weapon system for use in conjunction with a firearm, the barrel-interchangeable weapon system comprising:

a first grenade launcher barrel assembly;

an elongated chassis capable of being attached to and detached from the firearm, wherein said chassis is configured to removably attach to the first grenade launcher barrel assembly;

said chassis including an elongated upper chassis portion and an elongated lower chassis portion removably attachable to said upper chassis portion, said upper chassis portion and said lower chassis portion cooperating to circumscribe a barrel of the firearm;

said upper chassis portion having at least one lower edge;

said lower chassis portion having at least one upper edge engaging said at least one lower edge;

said lower chassis portion having a plate removably and slidably received within a channel formed in a distal end thereof, the plate slidable along a longitudinal axis of the lower chassis portion;

the plate resiliently engaging a locking tooth received within said channel and slidable therein along the longitudinal axis of the lower chassis portion, the locking tooth biased to resiliently engage a complementary feature on the first grenade launcher barrel assembly to secure the first grenade launcher barrel assembly to the lower chassis when the first grenade launcher barrel assembly is attached to the chassis; and the first grenade launcher barrel assembly removable from the lower chassis portion when the plate and the locking tooth are removed from the channel.

2. The barrel-interchangeable weapon system of claim 1, further comprising:

said lower chassis portion including a boss receiver configured to removably receive an upstanding boss on the at least one barrel assembly; and a fastener including a receiving channel configured to removably receive a complementary mating element of a grenade launcher trigger assembly.

3. The barrel-interchangeable weapon system of claim 2, further comprising:

said boss receiver being configured to pivotally receive the upstanding boss; and a latch mechanism in the lower chassis portion for selectively locking and unlocking the first grenade launcher barrel assembly when the first grenade launcher barrel assembly is attached to the lower chassis portion, wherein an axis of the first grenade launcher barrel assembly is parallel to an axis of a barrel of the firearm when the latch mechanism is locked and wherein the first grenade launcher barrel assembly is pivotable out of alignment with the barrel of the firearm when the latch mechanism is unlocked.

4. The barrel-interchangeable weapon system of claim 2, wherein the locking tooth engages an annular channel formed in the upstanding boss when the first grenade launcher barrel assembly is attached to the chassis.

5. The barrel-interchangeable weapon system of claim 1, further comprising a second grenade launcher barrel assembly, the second grenade launcher barrel assembly interchangeable with the first grenade launcher barrel assembly and configured to fire grenades having a caliber which is different than a caliber of the first grenade launcher barrel assembly.

6. The barrel-interchangeable weapon system of claim 5, wherein the first grenade launcher barrel assembly has a caliber of 40 millimeters and the second grenade launcher barrel assembly has a caliber of 25 millimeters.

7. The barrel-interchangeable weapon system of claim 2, wherein the trigger assembly includes a mounting shoe extending from an upper surface of the at least one trigger assembly and configured for slidable coupling with the receiving channel.

8. The barrel-interchangeable weapon system of claim 1, further comprising an accessory rail plate, the accessory rail plate having:

a first major surface configured to removably attach a firearm accessory; and a second major surface opposite the first major surface, the second major surface interfacing with the lower chassis portion, the accessory rail plate interchangeable with the first grenade launcher barrel assembly.

9. The barrel-interchangeable weapon system of claim 1, further comprising an accessory rail member disposed on at least one side surface of the lower chassis portion, the accessory rail member configured to removably secure a firearm accessory device.

10. The barrel-interchangeable weapon system of claim 9, further comprising the firearm accessory device, the firearm accessory device selected from the group consisting of a ballistics computer, fire control system, sighting device, range finder, laser designator, illuminator, camera, or any combination thereof.

11. A barrel-interchangeable weapon system comprising:

a frame having a fore end portion and a buttstock portion;

a first grenade launcher barrel assembly;

an elongated chassis capable of being attached to and detached from the frame, wherein said chassis is configured to removably attach to the first grenade launcher barrel assembly;

said chassis including an elongated upper chassis portion and an elongated lower chassis portion removably attachable to said upper chassis portion, said upper chassis portion and said lower chassis portion cooperating to circumscribe the fore end portion of the frame;

said upper chassis portion having at least one lower edge;

said lower chassis portion having at least one upper edge engaging said at least one lower edge;

said lower chassis portion having a plate removably and slidably received within a channel formed in a distal end thereof, the plate slidable along a longitudinal axis of the lower chassis portion;

the plate resiliently engaging a locking tooth received within said channel and slidable therein along the longitudinal axis of the lower chassis portion, the locking tooth biased to resiliently engage a complementary feature on the first grenade launcher barrel assembly to secure the first grenade launcher barrel assembly to the lower chassis when the first grenade launcher barrel assembly is attached to the chassis; and the first grenade launcher barrel assembly removable from the lower chassis portion when the plate and the locking tooth are removed from the channel.

12. The barrel-interchangeable weapon system of claim 11, further comprising:

said lower chassis portion including a boss receiver configured to removably receive an upstanding boss on the at least one barrel assembly; and a fastener including a receiving channel configured to removably receive a complementary mating element of a grenade launcher trigger assembly.

13. The barrel-interchangeable weapon system of claim 12, further comprising:

said boss receiver being configured to pivotally receive the upstanding boss; and a latch mechanism in the lower chassis portion for selectively locking and unlocking the first grenade launcher barrel assembly when the first grenade launcher barrel assembly is attached to the lower chassis portion, wherein an axis of the first grenade launcher barrel assembly is parallel to an axis of the barrel of the fore end portion when the latch mechanism is locked and wherein the first grenade launcher barrel assembly is pivotable out of alignment with the fore end portion when the latch mechanism is unlocked.

14. The barrel-interchangeable weapon system of claim 11, wherein the locking tooth engages an annular channel formed in the upstanding boss when the first grenade launcher barrel assembly is attached to the chassis.

15. The barrel-interchangeable weapon system of claim 11, further comprising a second grenade launcher barrel assembly, the second grenade launcher barrel assembly interchangeable with the first grenade launcher barrel assembly and configured to fire grenades having a caliber which is different than a caliber of the first grenade launcher barrel assembly.

16. The barrel-interchangeable weapon system of claim 15, wherein the first grenade launcher barrel assembly has a caliber of 40 millimeters and the second grenade launcher barrel assembly has a caliber of 25 millimeters.

17. The barrel-interchangeable weapon system of claim 12, wherein the trigger assembly includes a mounting shoe extending from an upper surface of the at least one trigger assembly and configured for slidable coupling with the receiving channel.

18. The barrel-interchangeable weapon system of claim 14, further comprising a hinged connection between the fore end portion and the buttstock portion.

19. The barrel-interchangeable weapon system of claim 14, further comprising a handgrip assembly removably attachable to the trigger assembly.

20. The barrel-interchangeable weapon system of claim 11, further comprising an accessory rail member disposed on at least one side surface of the lower chassis portion, the accessory rail member configured to removably secure a firearm accessory device.

21. The barrel-interchangeable weapon system of claim 20, further comprising the firearm accessory device, the firearm accessory device selected from the group consisting of a ballistics computer, fire control system, sighting device, range finder, laser designator, illuminator, camera, or any combination thereof.

* * * * *